US007983904B2

(12) United States Patent
Ehara et al.

(10) Patent No.: US 7,983,904 B2
(45) Date of Patent: Jul. 19, 2011

(54) SCALABLE DECODING APPARATUS AND SCALABLE ENCODING APPARATUS

(75) Inventors: Hiroyuki Ehara, Kanagawa (JP); Masahiro Oshikiri, Kanagawa (JP); Koji Yoshida, Kanagawa (JP)

(73) Assignee: PANASONIC Corporation, Osaka (JP)

( * ) Notice: Subject to any disclaimer, the term of this patent is extended or adjusted under 35 U.S.C. 154(b) by 988 days.

(21) Appl. No.: 11/718,437

(22) PCT Filed: Nov. 2, 2005

(86) PCT No.: PCT/JP2005/020201

§ 371 (c)(1),
(2), (4) Date: May 2, 2007

(87) PCT Pub. No.: WO2006/049205

PCT Pub. Date: May 11, 2006

(65) Prior Publication Data

US 2008/0126082 A1 May 29, 2008

(30) Foreign Application Priority Data

Nov. 5, 2004 (JP) ..... 2004-322954

(51) Int. Cl.
*G10L 19/14* (2006.01)

(52) U.S. Cl. ..... 704/205

(58) Field of Classification Search ..... 704/200–230
See application file for complete search history.

(56) References Cited

U.S. PATENT DOCUMENTS 5,581,652 A * 12/1996 Abe et al. ..... 704/222
5,774,835 A * 6/1998 Ozawa ..... 704/205
6,507,820 B1 1/2003 Deutgen
6,611,800 B1 * 8/2003 Nishiguchi et al. ..... 704/221
7,205,910 B2 * 4/2007 Honma et al. ..... 341/50
2003/0088423 A1 * 5/2003 Nishio et al. ..... 704/500
2003/0158726 A1 * 8/2003 Philippe et al. ..... 704/203
2005/0080621 A1 * 4/2005 Tsushima et al. ..... 704/229

(Continued)

FOREIGN PATENT DOCUMENTS

WO 01/03124 1/2001

OTHER PUBLICATIONS

Kovesi, B. et al., "A Scalable Speech and Audio Coding Scheme with Continuous Bitrate Flexibility", Proc. of ICASSP-04, vol. 1, Mar. 17, 2004, p. 1-273-276.

(Continued)

*Primary Examiner* — Abul Azad

(74) *Attorney, Agent, or Firm* — Greenblum & Bernstein, P.L.C.

(57) ABSTRACT

A scalable decoding apparatus capable of providing decoded audio signals of high quality having less degradation of a high frequency spectrum even when decoding audio signals by generating the high frequency spectrum by use of a low frequency spectrum. In the apparatus, an amplitude adjusting part uses different adjustment coefficients in accordance with the characteristic of first layer spectrum information to adjust the amplitude of a first layer decoded signal spectrum, and then outputs the amplitude-adjusted first layer decoded signal spectrum to a pseudo-spectrum generating part. Using amplitude-adjusted first layer decoded signal spectrum received from the amplitude adjusting part, the pseudo-spectrum generating part generates and outputs a pseudo-spectrum of high frequencies to a scaling part. The scaling part scales the spectrum received from the pseudo-spectrum generating part and then outputs it to an adder.

7 Claims, 26 Drawing Sheets

U.S. PATENT DOCUMENTS

| | | | | |
|---|---|---|---|---|
| 2005/0203736 | A1 | 9/2005 | Yasunaga et al. | |
| 2006/0235682 | A1 | 10/2006 | Yasunaga et al. | |
| 2006/0251178 | A1* | 11/2006 | Oshikiri | 375/242 |
| 2007/0100613 | A1 | 5/2007 | Yasunaga et al. | |

OTHER PUBLICATIONS

U.S. Appl. No. 11/573,761 to Ehara et al., filed Feb. 15, 2007.
U.S. Appl. No. 11/576,264 to Goto et al., filed Mar. 29, 2007.
Oshikiri et al., "Pichi Filtering ni Motozuku Spectre Fugoka o Mochiita Choko Taiiki Schelable Onsei Fugoka no Kaizen", The Acoustical Society of Japan (ASJ) 2004 Nen Shuki Kenkyu Happyokai Koen Ronbunshu-I-, 2-4-13, Sep. 21, 2004, pp. 297 to 298. (including partial English language translation).
Oshikiri et al., "Pichi Filtering ni Motozuku Spectre Fugoka o Mochiita Choko Taiiki Schelable Onsei Fugoka no Kaizen", The Acoustical Society of Japan (ASJ) 2004 Nen Shuki Kenkyu Happyokai Koen Ronbunshu-I-, 2-4-13, Sep. 21, 2004, pp. 297 to 298, XP002998459.
Makhoul J et al., "High-Frequency Regeneration in Speech Coding Systems", International Conference on Acoustics, Speech & Signal Processing, ICASSP. Washington, Apr. 2-4, 1979; [International Conference on Acoustics, Speech & Signal Processing, ICASSP], New York, IEEE, US, vol. Conf. 4, Jan. 1, 1979, pp. 428-431, XP001122019.
Kovesi, B. et al., "A Scalable Speech and Audio Coding Scheme with Continuous Bitrate Flexibility", Proc. of ICASSP-04, vol. 1, Mar. 17, 2004, p. I-273-276.
Oshikiri M et al. , Efficient spectrum coding for super-wideband speech and its application to 7/10/15 KHz bandwidth scalable coders, Acoustics, Speech, and Signal Processing, 2004, Proceedings, (ICASSP '04), IEEE International Conference on Montreal, Quebec, Canada May 17-21, 2004, Piscataway, NJ, USA, IEEE, Piscataway, NJ, USA, LNKD-DOI: 10.1109/ICASSP.2004.1326027, vol. 1, May 17, 2004, pp. 481-484, XP010717670.

* cited by examiner

SCALABLE DECODING APPARATUS AND SCALABLE ENCODING APPARATUS

TECHNICAL FIELD

The present invention relates to a scalable decoding apparatus and scalable encoding apparatus used for carrying out communication using speech signals and audio signals in a mobile communication system and a packet communication system using Internet protocol.

BACKGROUND ART

In order to effectively utilize radio wave resources in a mobile communication system, it is required to compress speech signals at a low bit rate. On the other hand, it is expected from the user to improve quality of communication speech and implement communication services with high presence. In order to implement this, it is preferable not only to improve quality of speech signals, but also to be capable of encoding signals other than speech, such as audio signals having a wider band with high quality.

Further, in an environment where various types of networks are present, a speech coding scheme is required that can flexibly support communication between different networks, communication between terminals utilizing different services, communication between terminals having different processing performance, and conversational communication at multipoints as well as communication between two parties.

Moreover, a speech coding scheme is required to be robust against transmission path errors (in particular, packet loss in packet switching networks typified by IP networks).

One speech coding scheme satisfying such requirements is the bandwidth scalable speech coding scheme. The bandwidth scalable coding scheme is a coding scheme that encodes speech signals in a layered way, and a coding scheme where coding quality increases in accordance with an increase in the number of coding layers. The bit rate can be set variable by increasing or decreasing the number of coding layers, so that it is possible to effectively use transmission path capacity.

Further, with the bandwidth scalable speech coding scheme, it is only necessary to receive at least the data coded by a base layer at a decoder side, and it is possible to allow to some extent information coded by additional layers being lost on the transmission path, and therefore the bandwidth scalable speech coding scheme provides robustness against transmission path errors. Further, the frequency bandwidth of speech signals to be encoded also becomes wider in accordance with an increase in the number of coding layers. For example, for a base layer (i.e. core layer), a coding scheme for telephone band speech of the related art is used. Further, in additional layers (i.e. enhancement layers), layers are configured so that wideband speech which has a bandwidth such as 7 kHz can be encoded.

In this way, with the band scalable speech coding scheme, telephone band speech signals are encoded in the core layer, and high-quality wideband signals are encoded in the enhancement layers, so that it is possible to utilize the bandwidth scalable speech coding scheme for both telephone band speech service terminals and high-quality wideband speech service terminals and support multipoint communication including the two kinds of terminals. Further, the coded information is layered, so that it is possible to increase error robustness by devising a transmission method, and readily control the bit rate on the encoding side or on the transmission path. Therefore, the bandwidth scalable speech coding scheme draws attention as a speech coding scheme for future communication.

The method disclosed in non-patent document 1 is given as an example of the bandwidth scalable speech coding scheme described above.

In the bandwidth scalable speech coding scheme disclosed in non-patent document 1, MDCT coefficients are encoded using a scale factor and fine structure information for each band. The scale factor is Huffman encoded, and the fine structure is subjected to vector quantization. Auditory weighting of each band is calculated using a scale factor decoding result, and the bit allocation to each band is decided. The bandwidth of each band is non-uniform and set in advance so as to become wider for a higher band.

Further, transmission information is classified into four groups as described below.

A: Core codec coding information

B: High-band scale factor coding information

C: Low-band scale factor coding information

D: Spectrum fine structure coding information

Further, the following processing is carried out on the decoding side.

<Case 1> When information for A cannot be received completely, decoded speech is generated by carrying out frame erasure concealment processing.

<Case 2> When only information for A is received, a decoded signal for the core codec is outputted.

<Case 3> When information for B is received in addition to the information for A, a high band is generated by mirroring the decoded signal for the core codec and a decoded signal having a wider bandwidth than the decoded signal of the core codec is generated. Decoded information for B is used in generation of high band spectrum shapes. Mirroring is carried out at a voiced frame, and is carried out so that the harmonic structure does not collapse. The high band is generated at an unvoiced frame using random noise.

<Case 4> When information for C is received in addition to information for A and B, the same decoding processing as in case 3 is carried out using only information for A and B.

<Case 5> When information for D is received in addition to the information for A, B and C, complete decoding processing is carried out at bands where all information for A to D is received, and a fine spectrum is decoded by mirroring a decoded signal spectrum on the low band side at bands where information for D is not received. Even if the information for D is not received, it is possible to receive the information for B and C, and this information for B and C is utilized in decoding of spectrum envelope information. Mirroring is carried out at a voiced frame, and is carried out so that the harmonic structure does not collapse. The high band is generated at an unvoiced frame using random noise.

Non-patent document 1: B. Kovesi et al, "A scalable speech and audio coding scheme with continuous bit rate flexibility," in proc. IEEE ICASSP2004, pp. I-273--I-276.

DISCLOSURE OF INVENTION

Problems to be Solved by the Invention

In the technique of the related art (non-patent document 1), a high band is generated by mirroring. At this time, mirroring is carried out so that a harmonic structure does not collapse, so that this harmonic structure is maintained. However, the low band harmonic structure appears in the high band as a mirror image. Typically, in a voiced signal, a harmonic structure is more likely to collapse in the higher band, and therefore the harmonic structure does not appear more markedly at the high band than the low band. In other words, although valleys of harmonics are deep at the low band, at the high band, valleys of harmonics are shallow, or, depending on the case, the harmonic structure itself becomes less defined. Therefore, with the technique of the related art described above, a harmonic structure excessively appears more easily at high band components, and therefore, the quality of the decoded speech signal deteriorates.

It is therefore an object of the preset invention to provide a scalable decoding apparatus and a scalable encoding apparatus capable of obtaining a high-quality decoded speech (or audio) signal with little deterioration in the high band spectrum even when a speech (audio) signal is decoded by generating a high band spectrum using a low band spectrum.

Means for Solving the Problem

A scalable decoding apparatus of the present invention adopts a configuration including: a first decoding section that decodes low frequency band coding information and obtains a low frequency band decoded signal; a second decoding section that obtains a high frequency band decoded signal from the low frequency band decoded signal and high frequency band coding information, wherein the second decoding section includes: a transform section that transforms the low frequency band decoded signal and obtains a low frequency band spectrum; an adjusting section that carries out amplitude adjustment on the low frequency band spectrum; and a generating section that generates a high frequency band spectrum in a pseudo manner using the amplitude-adjusted low frequency band spectrum and the high frequency band coding information.

Advantageous Effect of the Invention

According to the preset invention, it is possible to obtain a high quality decoded speech (or audio) signal with little deterioration in the high band spectrum even when the speech (or audio) signal is decoded by generating a high band spectrum using a low band spectrum.

BEST MODE FOR CARRYING OUT THE INVENTION

Embodiments of the present invention will be described in detail below with reference to the accompanying drawings.

Embodiment 1

Figure 1:
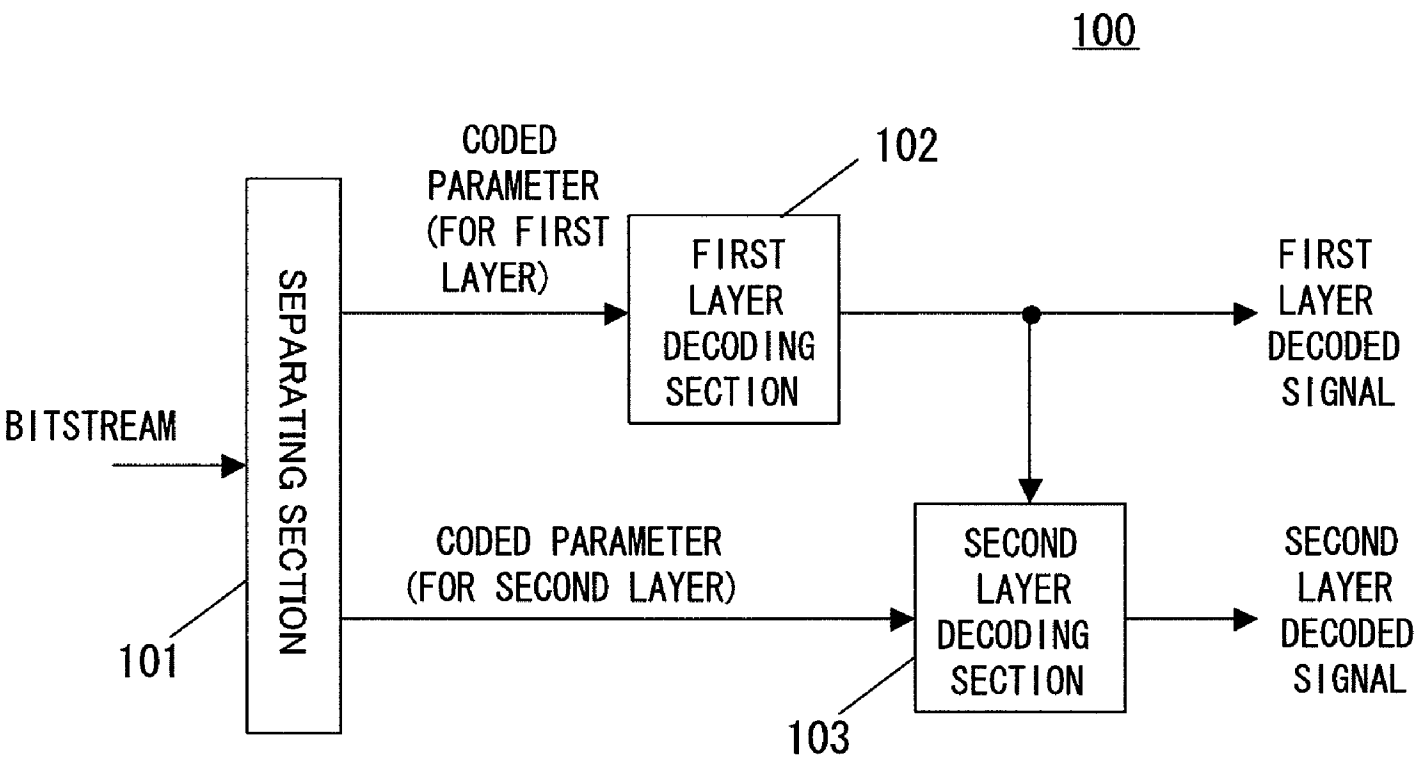
FIG. 1 is a block diagram showing a configuration of a scalable decoding apparatus according to Embodiment 1 of the present invention.

FIG. 1 is a block diagram showing a configuration of a scalable decoding apparatus for forming, for example, a bandwidth scalable speech (or audio) signal decoding apparatus.

Scalable decoding apparatus 100 includes separating section 101, first layer decoding section 102 and second layer decoding section 103.

Separating section 101 receives a bitstream transmitted from the scalable encoding apparatus described later, separates the bitstream into a first layer coding parameter and a second layer coding parameter, and outputs the parameters respectively to first layer decoding section 102 and second layer decoding section 103.

First layer decoding section 102 decodes the first layer coding parameter inputted from separating section 101 and outputs a first layer decoded signal. This first layer decoded signal is also outputted to second layer decoding section 103.

Second layer decoding section decodes the second layer coding parameter inputted from separating section 101 using the first layer decoded signal inputted from first layer decoding section 102 and outputs a second layer decoded signal.

Figure 2:
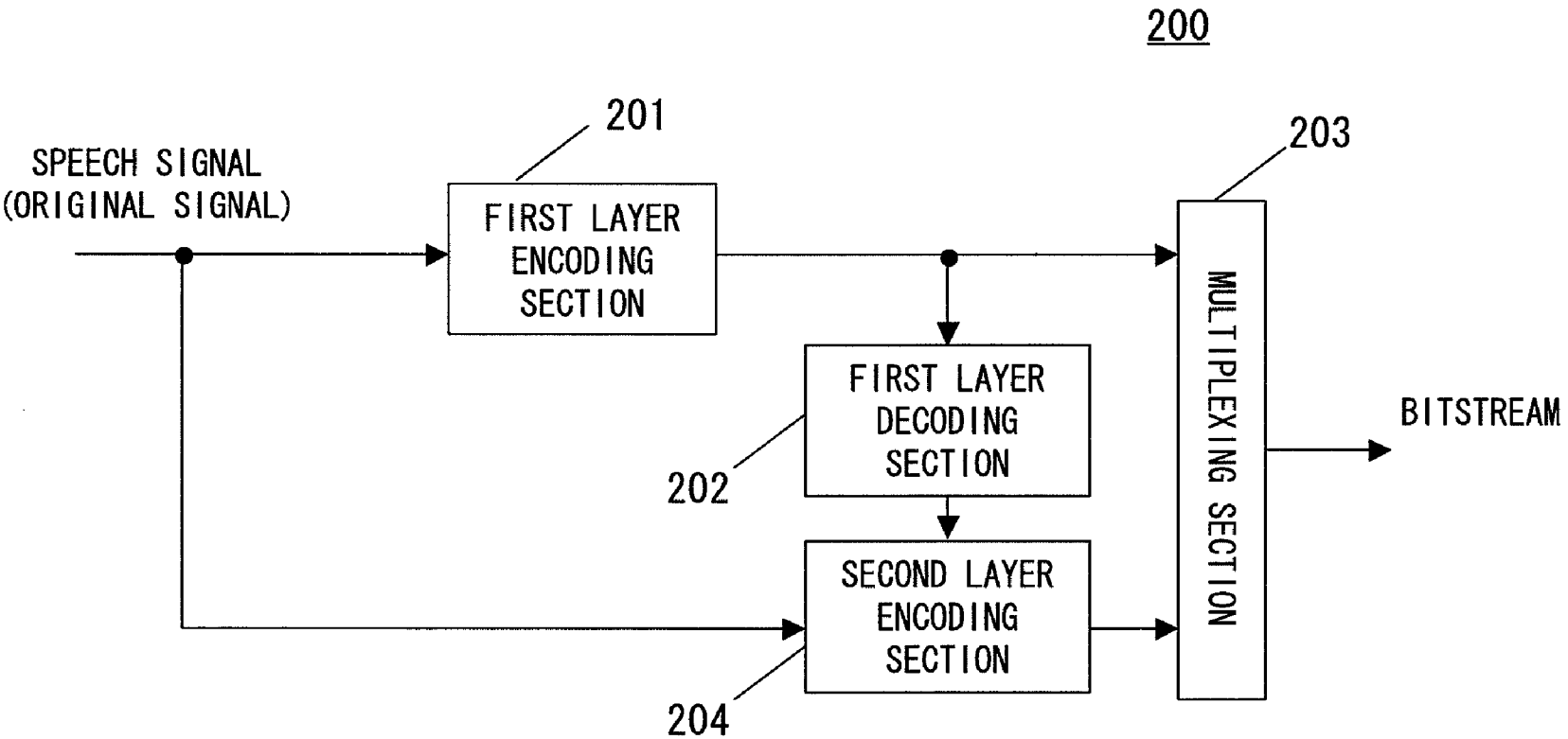
FIG. 2 is a block diagram showing a configuration of a scalable encoding apparatus according to Embodiment 1 of the present invention.

An example of a configuration of scalable encoding apparatus 200 corresponding to scalable decoding apparatus 100 of FIG. 1 is shown in FIG. 2.

In FIG. 2, first layer encoding section 201 encodes the inputted speech signal (i.e. original signal) and outputs the obtained parameters coded to first layer decoding section 202 and multiplexing section 203. First layer decoding section 201 implements bandwidth scalability for the first and second layers by carrying out downsampling processing and low pass filtering processing for encoding.

First layer decoding section 202 then generates a first layer decoded signal from coded parameters inputted from first layer encoding section 201 and outputs the first layer decoded signal to second layer encoding section 204.

Second layer encoding section 204 then encodes the inputted speech signal (i.e. original signal) using the first layer decoded signal inputted from first layer decoding section 202 and outputs the obtained parameter coded to multiplexing section 203. Second layer encoding section 204 carries out upsampling processing of the first layer decoded signal and phase adjustment processing in order to match the phases of the first decoded signal and the inputted speech signal according to processing carried out at first layer encoding section 201 (such processing includes downsampling processing or low pass filtering processing) for encoding.

Multiplexing section 203 then multiplexes the coding parameter inputted from first layer encoding section 201 and the coded parameter inputted from second layer encoding section 204, and outputs the result as a bitstream.

Figure 3:
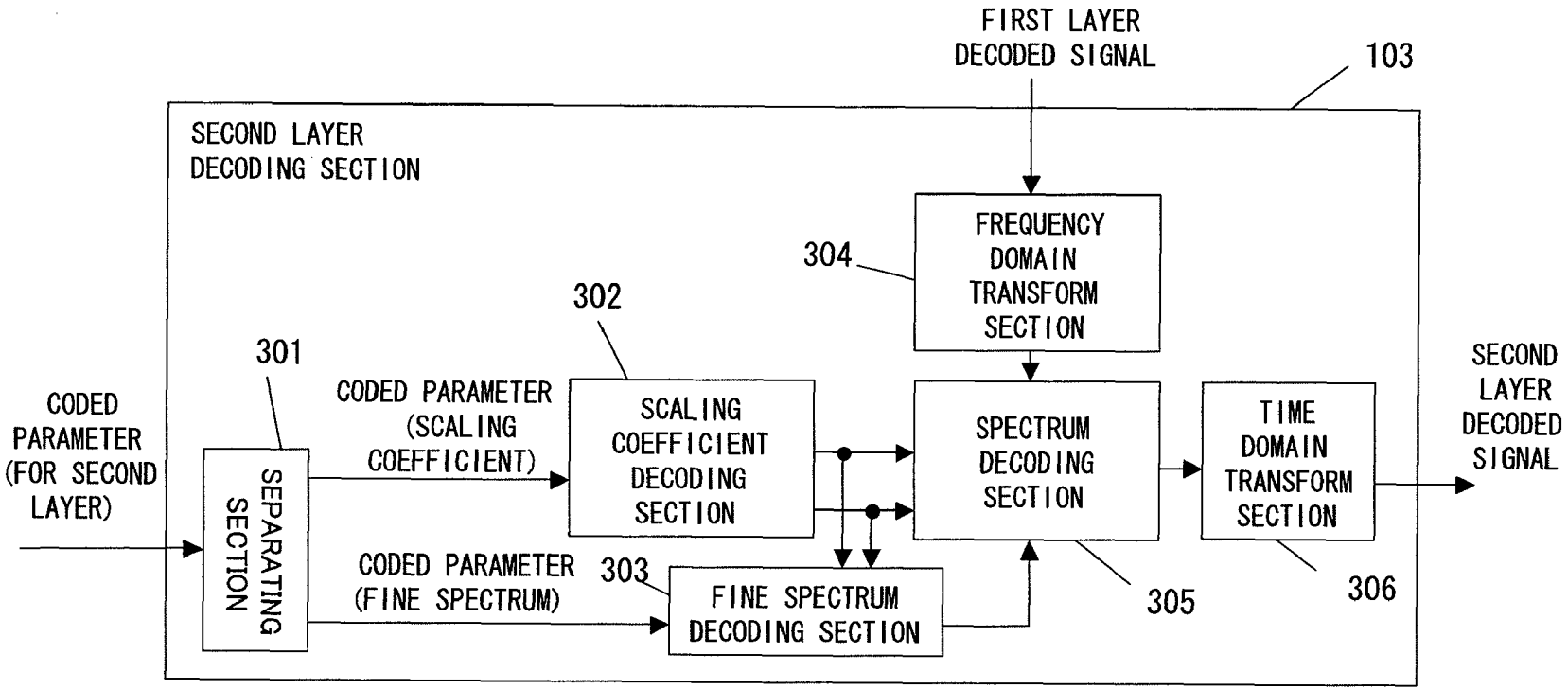
FIG. 3 is a block diagram showing a configuration of a second layer decoding section according to Embodiment 1 of the present invention.

Next, second layer decoding section 103 shown in FIG. 1 will be described in detail. FIG. 3 is a block diagram showing a configuration of second layer decoding section 103. Second layer decoding section 103 includes separating section 301, scaling coefficient decoding section 302, fine spectrum decoding section 303, frequency domain transform section 304, spectrum decoding section 305 and time domain transform section 306.

Separating section 301 separates the inputted second layer coded parameter into a coding parameter indicating scaling coefficients (i.e. scaling coefficient parameter) and a coding parameter indicating fine spectrum structure (i.e. fine spectrum parameter) and outputs the coding parameters to scaling coefficient decoding section 302 and fine spectrum decoding section 303, respectively.

Scaling coefficient decoding section 302 decodes the inputted scaling coefficient parameter so as to obtain low band scaling coefficients and high band scaling coefficients, and outputs the decoded scaling coefficients to spectrum decoding section 305 and fine spectrum decoding section 303.

Fine spectrum decoding section 303 calculates auditory weighting of each band using the scaling coefficients inputted from scaling coefficient decoding section 302 and obtains the number of bits allocated to fine spectrum information of each band. Fine spectrum decoding section 303 then decodes the fine spectrum parameters inputted from separating section 301 and obtains decoded fine spectrum information of each band, and outputs the result to spectrum decoding section 305. It is also possible to use information for the first layer decoded signal in calculation of auditory weighting, and in this case, the output of frequency domain transform section 304 is also inputted to fine spectrum decoding section 303.

Frequency domain transform section 304 transforms the inputted first layer decoded signal to a frequency domain spectrum parameter (for example, MDCT coefficients), and outputs the result to spectrum decoding section 305.

Spectrum decoding section 305 decodes the second decoded signal from the first layer decoded signal which is inputted from frequency domain transform section 304 and transformed to a frequency domain, the decoding scaling coefficients (for low band and high band) inputted from scaling coefficient decoding section 302, and the decoding fine spectrum information inputted from fine spectrum decoding section 303, and outputs the result to time domain transform section 306.

Time domain transform section 306 transforms a spectrum of the second layer decoded signal inputted from spectrum decoding section 305 to a time domain signal and outputs the result as a second layer decoded signal.

Figure 4:
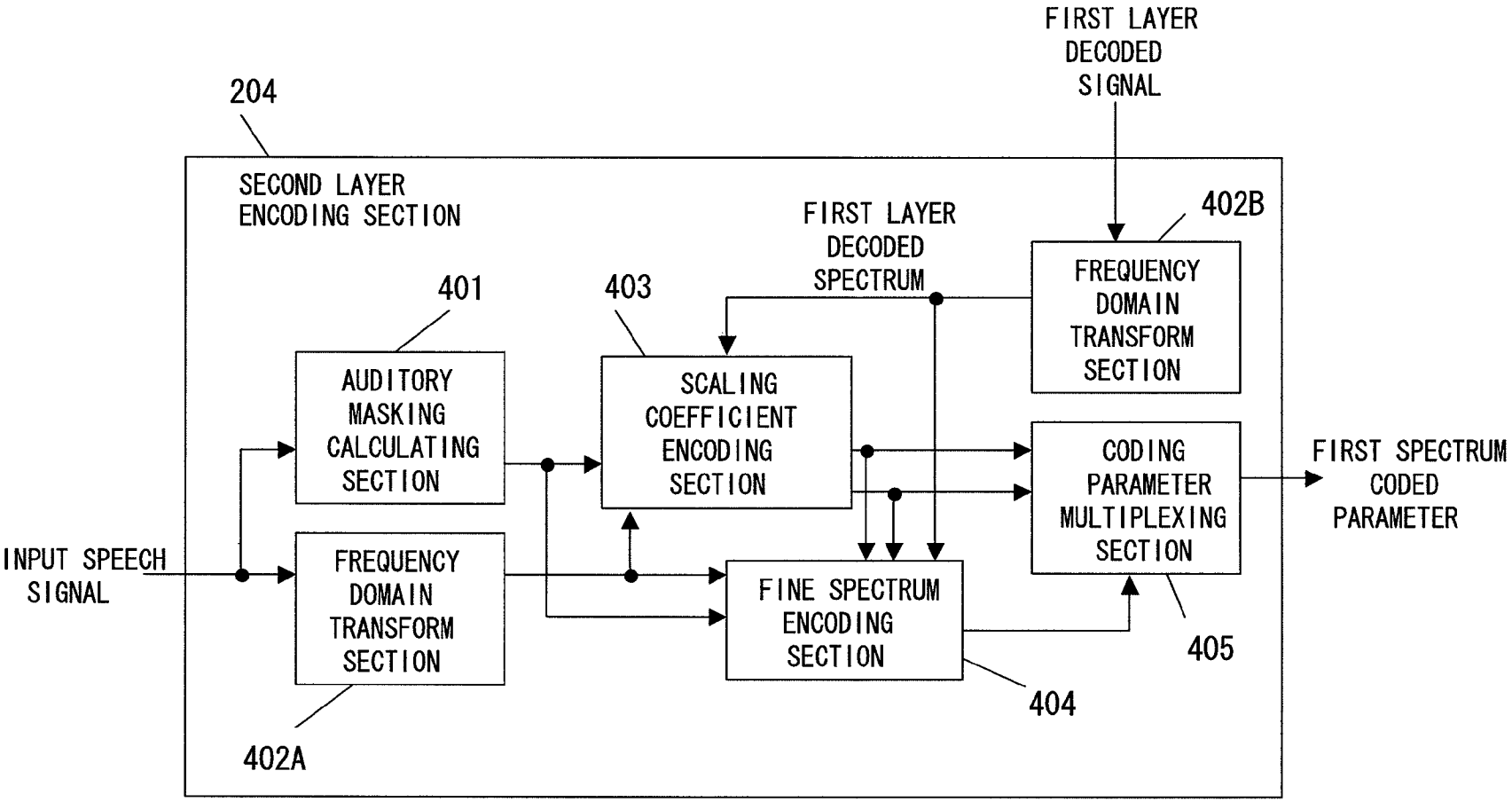
FIG. 4 is a block diagram showing a configuration of a second layer encoding section according to Embodiment 1 of the present invention.

An example of a configuration of second layer encoding section 204 corresponding to second layer decoding section 103 of FIG. 3 is shown in FIG. 4.

In FIG. 4, the inputted speech signal is inputted to auditory masking calculating section 401 and frequency domain transform section 402A.

Auditory masking calculating section 401 calculates auditory masking for each subband having a pre-defined bandwidth and outputs this auditory masking to scaling coefficient encoding section 403 and fine spectrum encoding section 404.

Here, human auditory perception has auditory masking characteristics that, when a given signal is being heard, even if sound having a frequency close to that signal comes to the ear, the sound is difficult to be heard. It is therefore possible to implement efficient spectrum encoding by, using the auditory masking based on this auditory masking characteristic, allocating a small number of quantization bits to a frequency spectrum where quantization distortion is difficult to be perceived and allocating a large number of quantization bits to a frequency spectrum where quantization distortion is easy to be perceived.

Frequency domain transform section 402A transforms the inputted speech signal to a frequency domain spectrum parameter (for example, MDCT coefficients) and outputs the result to scaling coefficient encoding section 403 and spectrum encoding section 404. Frequency domain transform section 402B transforms the inputted first layer decoded signal to a frequency domain spectrum parameter (for example, MDCT coefficients) and outputs the result to scaling coefficient encoding section 403 and spectrum encoding section 404.

Scaling coefficient encoding section 403 encodes a differential spectrum between the spectrum parameter inputted from frequency domain transform section 402A and the first layer decoded spectrum inputted from frequency domain transform section 402 using the auditory masking information inputted from auditory masking calculating section 401, obtains a scaling coefficient parameter, and outputs the scaling coefficient parameter to coded parameter multiplexing section 405 and fine spectrum encoding section 404. Here, an example is shown where a high band spectrum scaling coefficient parameter and a low band spectrum scaling coefficient parameter are outputted separately.

Fine spectrum encoding section 404 decodes the scaling coefficient parameter (for low band and high band) inputted from scaling coefficient encoding section 403, obtains decoded scaling coefficients (for low band and high band), and normalizes a differential spectrum between the spectrum parameter inputted from frequency domain transform section 402A and the first layer decoded spectrum inputted from frequency domain transform section 402B using decoded scaling coefficients (for low band and high band). Fine spectrum encoding section 404 encodes the normalized differential spectrum, and outputs the differential spectrum after encoding (i.e. fine spectrum coding parameters) to coding parameter multiplexing section 405. At this time, fine spectrum encoding section 404 calculates perceptual importance of fine spectrum in each band using decoded scaling coefficients (for low band and high band) and defines bit allocation according to the perceptual importance. It is also possible to calculate this perceptual importance using the first layer decoded spectrum.

Coded parameter multiplexing section 405 multiplexes the high band spectrum scaling coefficient parameter and the low band spectrum scaling coefficient parameter inputted from scaling coefficient encoding section 403 and the fine spectrum coding parameter inputted from fine spectrum encoding section 404 and outputs the result as a first spectrum coded parameter.

Next, spectrum decoding section 305 shown in FIG. 3 will be described in detail. FIG. 5 to FIG. 9 are block diagrams showing a configuration of spectrum decoding section 305.

Figure 5:
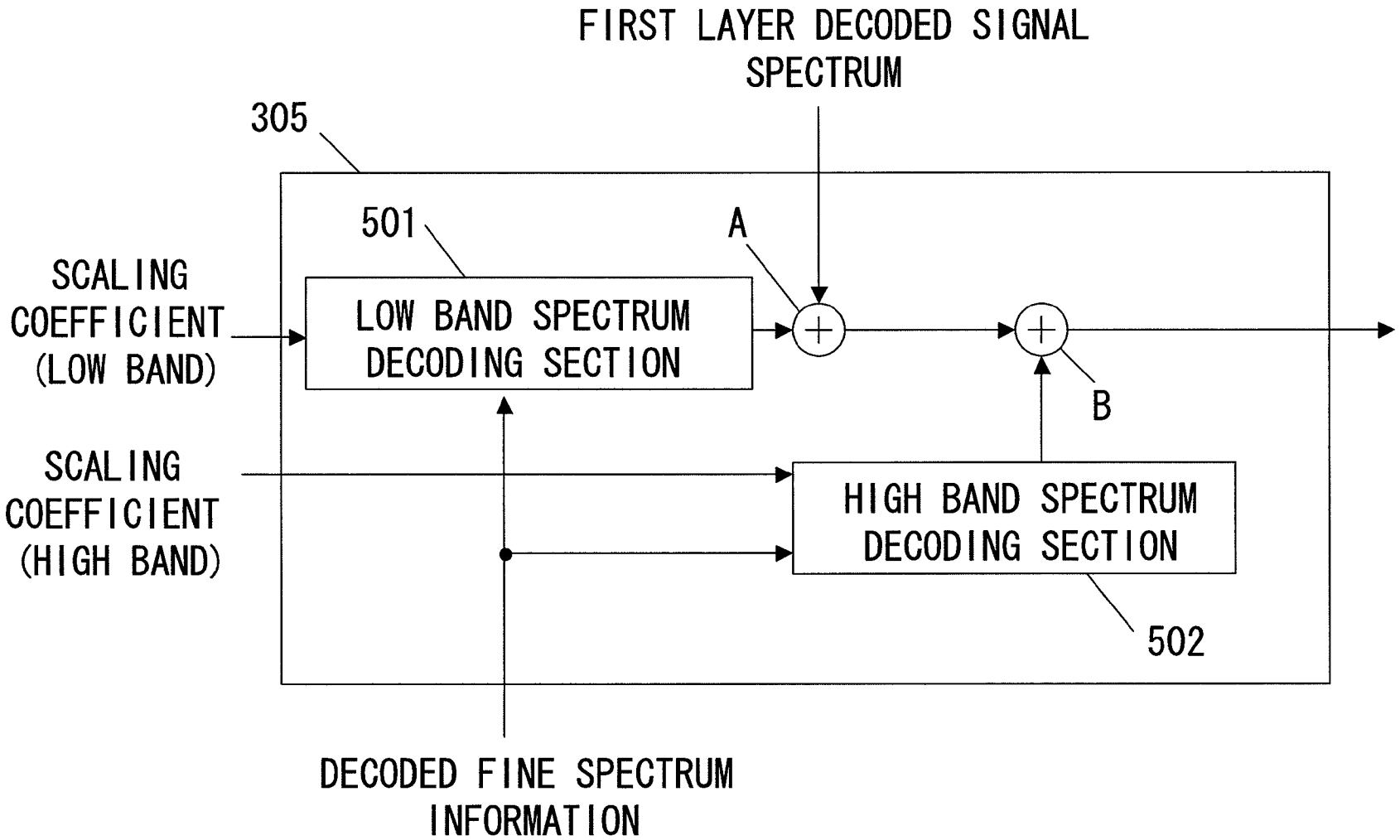
FIG. 5 is a block diagram showing a configuration of a spectrum decoding section according to Embodiment 1 of the present invention.

FIG. 5 shows a configuration for executing processing when the first layer decoded signal, all decoding scaling coefficients (for low band and high band) and all fine spectrum decoding information are received normally.

Figure 6:
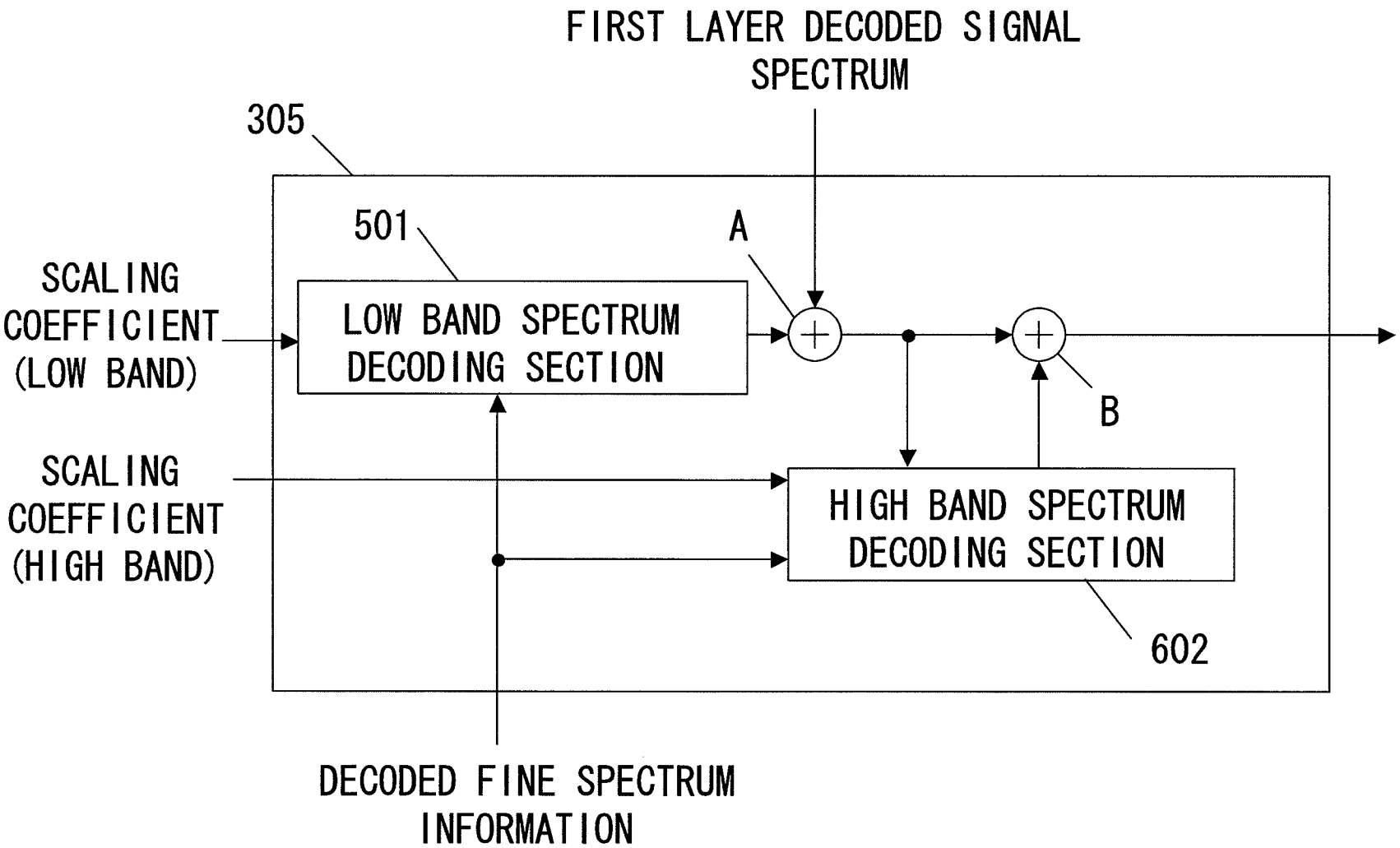
FIG. 6 is a further block diagram showing a configuration of the spectrum decoding section according to Embodiment 1 of the present invention.

FIG. 6 shows a configuration for executing processing when part of the fine spectrum decoding information for the high band is not received. FIG. 6 differs from FIG. 5 in that the output result of adder A is inputted to high band spectrum decoding section 602. A spectrum for the bands to be decoded using high band fine spectrum decoding information that is not received is generated in a pseudo manner using the following method.

Figure 7:
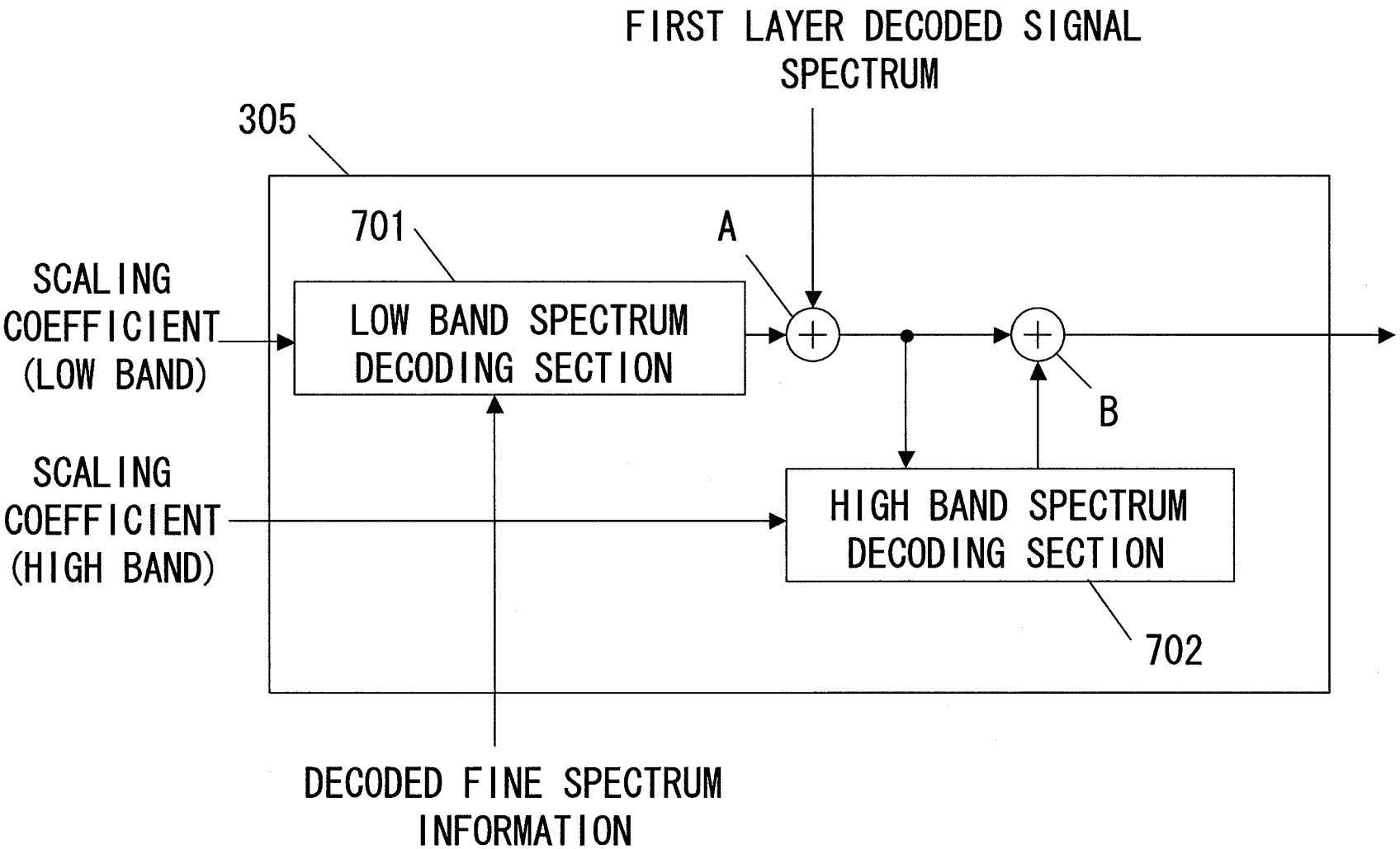
FIG. 7 is another block diagram showing a configuration of the spectrum decoding section according to Embodiment 1 of the present invention.

FIG. 7 shows a configuration for executing processing when none of the high band fine spectrum decoding information is received (including the case where part of the low band fine spectrum decoding information is not received). This differs from FIG. 6 in that the fine spectrum decoding information is not inputted to high band spectrum decoding section 702. A spectrum for the bands to be decoded using high band fine spectrum decoding information that is not received is generated in a pseudo manner using the following method.

Figure 8:
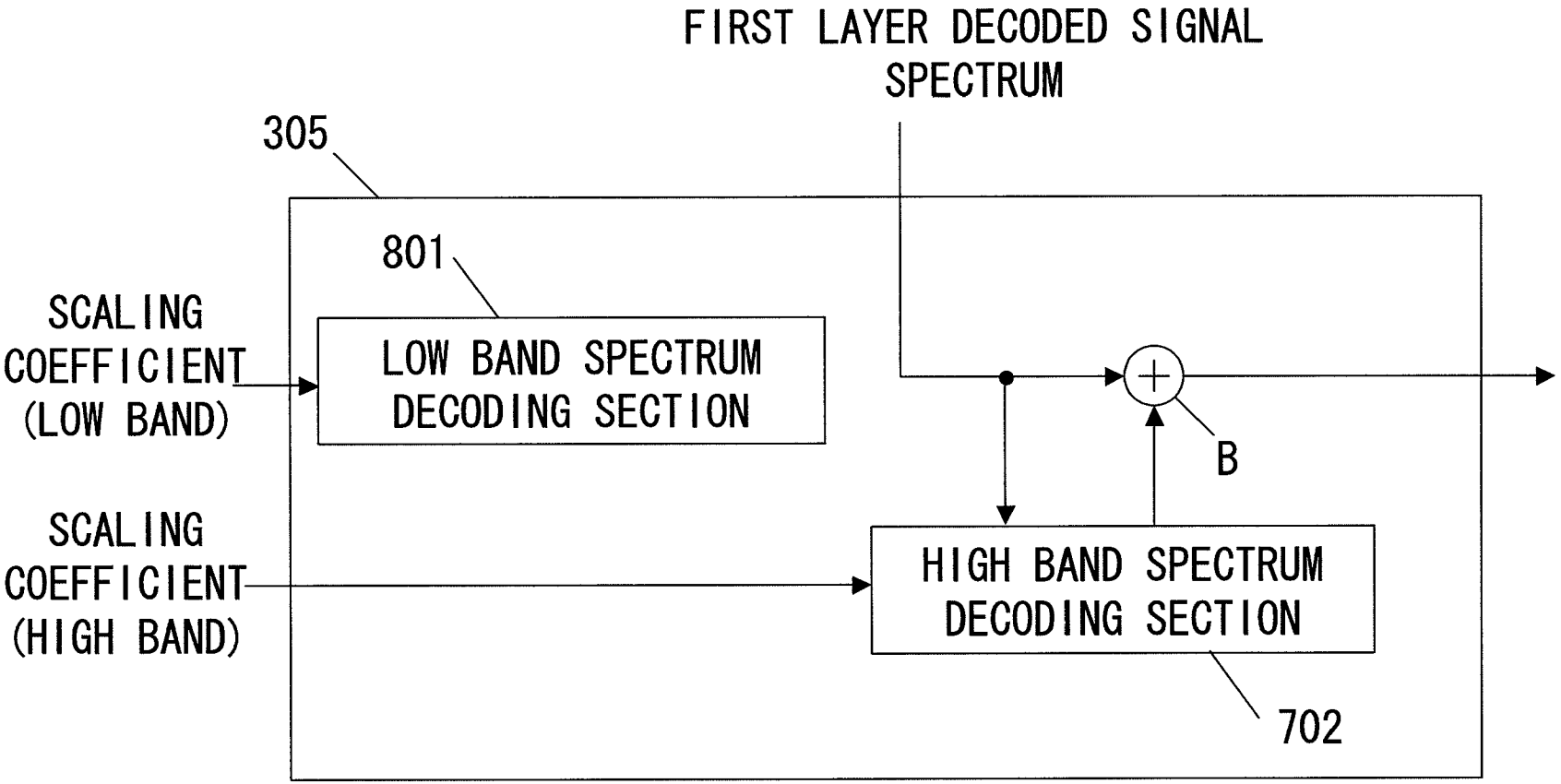
FIG. 8 is a further block diagram showing a configuration of the spectrum decoding section according to Embodiment 1 of the present invention.

FIG. 8 shows a configuration for executing processing when none of the fine spectrum decoding information is not received, and further, part of the low band decoding scaling coefficients is not received. This differs from FIG. 7 in that fine spectrum decoding information is not inputted, there is no output from low band spectrum decoding section 801, and adder A does not exist. A spectrum for bands to be decoded using high band fine spectrum decoding information that is not received is generated in a pseudo manner using the following method.

Figure 9:
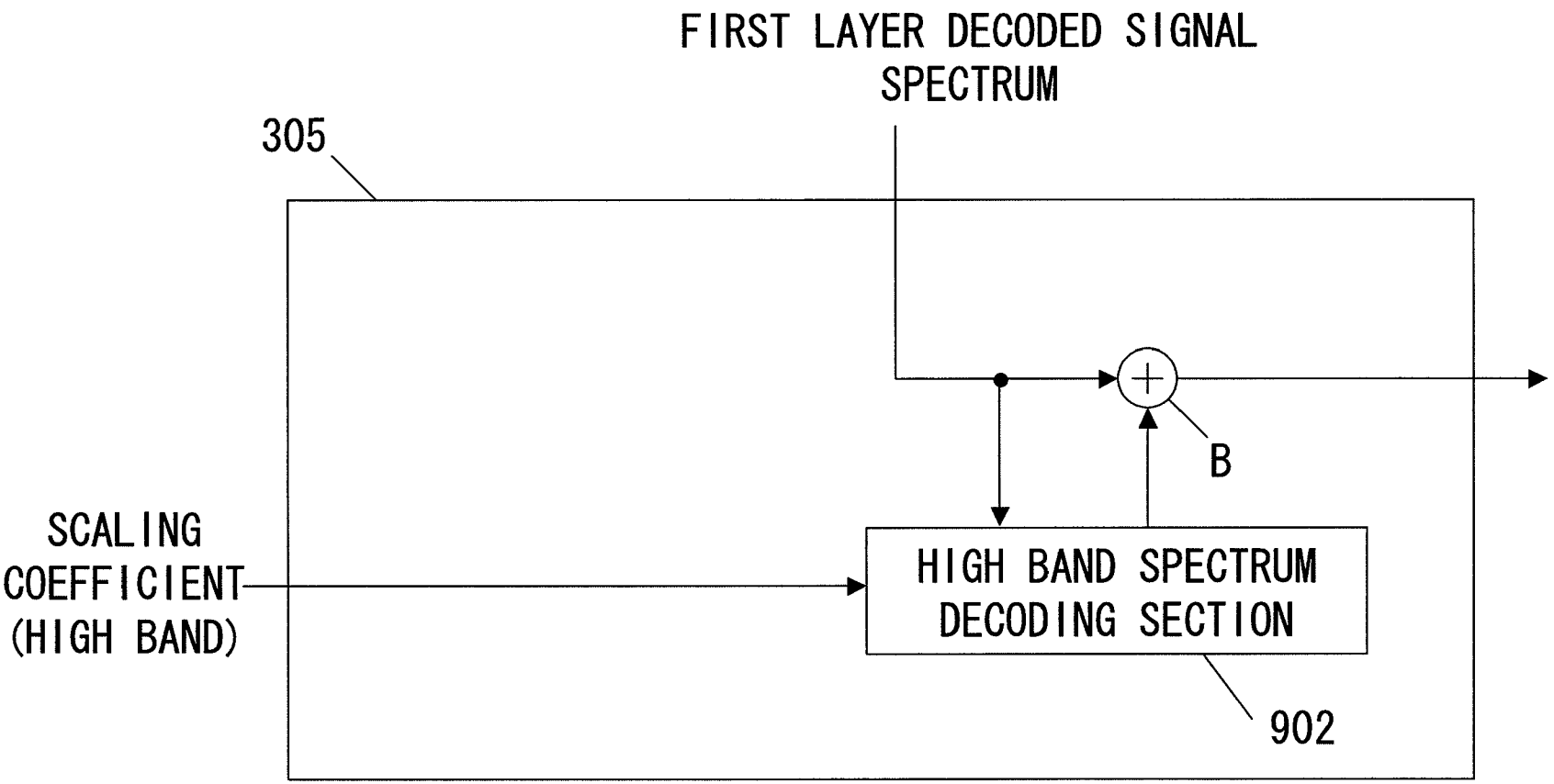
FIG. 9 is a still further block diagram showing a configuration of the spectrum decoding section according to Embodiment 1 of the present invention.

FIG. 9 shows a configuration for executing processing when only high band decoding scaling coefficients are received (including the case where part of the high band decoding scaling coefficients is not received). This differs from FIG. 8 in that there is no input of the low band decoding scaling coefficients, and low band spectrum decoding section does not exist. A method for generating a high band spectrum in a pseudo manner from only the received high band decoding scaling coefficients will be described later.

Spectrum decoding section 305 of FIG. 5 is provided with low band spectrum decoding section 501, high band spectrum decoding section 502, adder A and adder B.

Low band spectrum decoding section 501 decodes the low band spectrum using low band decoding scaling coefficients inputted from scaling coefficient decoding section 302 and fine spectrum decoding information inputted from fine spectrum decoding section 303, and outputs the result to adder A. Typically, a decoded spectrum is calculated by multiplying fine spectrum decoding information by decoding scaling coefficients.

Adder A adds the decoded low band (residual) spectrum inputted from low band spectrum decoding section 501 and the first layer decoded signal (i.e. spectrum) inputted from frequency domain transform section 302 so as to obtain a decoded low band spectrum and outputs the result to adder B.

High band spectrum decoding section 502 decodes the high band spectrum using the high band decoding scaling coefficients inputted from scaling coefficient decoding section 302 and the fine spectrum decoding information inputted from fine spectrum decoding section 303, and outputs the result to adder B.

Adder B adds the decoded low band spectrum inputted from adder A and the decoded high band spectrum inputted from high band spectrum decoding section 502 so as to generate a spectrum for all bands (all frequency bands combining the low band and the high band), and outputs the result as a decoded spectrum.

FIG. 6 differs from FIG. 5 in only the operation of high band spectrum decoding section 602.

High band spectrum decoding section 602 decodes the high band spectrum using the high band decoding scaling coefficients inputted from scaling coefficient decoding section 302 and the high band fine spectrum decoding information inputted from fine spectrum decoding section 303. At this time, the high band fine spectrum decoding information for part of the band is not received, and therefore the high band spectrum of the corresponding band cannot be decoded accurately. High band spectrum decoding section 602 then generates a high band spectrum in a pseudo manner using the decoded scaling coefficients, the low band decoded spectrum inputted from adder A, and the high band spectrum capable of being received and accurately decoded. A specific generating method is described in the following.

FIG. 7 shows operation in FIG. 5 and FIG. 6 for the case where all high band fine spectrum decoding information is not received. In this case, high band spectrum decoding section 702 decodes high band spectrum using just high band decoding scaling coefficients inputted from scaling coefficient decoding section 302.

Further, low band spectrum decoding section 701 decodes the high band spectrum using the low band decoding scaling coefficients inputted from scaling coefficient decoding section 302 and the low band fine spectrum decoding information inputted from fine spectrum decoding section 303. At this time, the low band fine spectrum decoding information for some part of the band is not received. Therefore, this part of the band is not subjected to decoding processing and taken to be a zero spectrum. In this case, a spectrum of the corresponding band outputted via adders A and B is the first layer decoded signal (spectrum) itself.

FIG. 8 shows operation for the case where all low band fine spectrum decoding information is not received in FIG. 7. Low band spectrum decoding section 801 receives low band decoding scaling coefficients, but does not receive fine spectrum decoding information at all, and decoding processing is therefore not carried out.

FIG. 9 shows the operation for the case where decoding scaling coefficients for the low band are not inputted at all in FIG. 8. However, at high band spectrum decoding section 902, when part of the decoding scaling coefficients (for high band) is not inputted, the spectrum for this band is outputted as zero.

Figure 10:
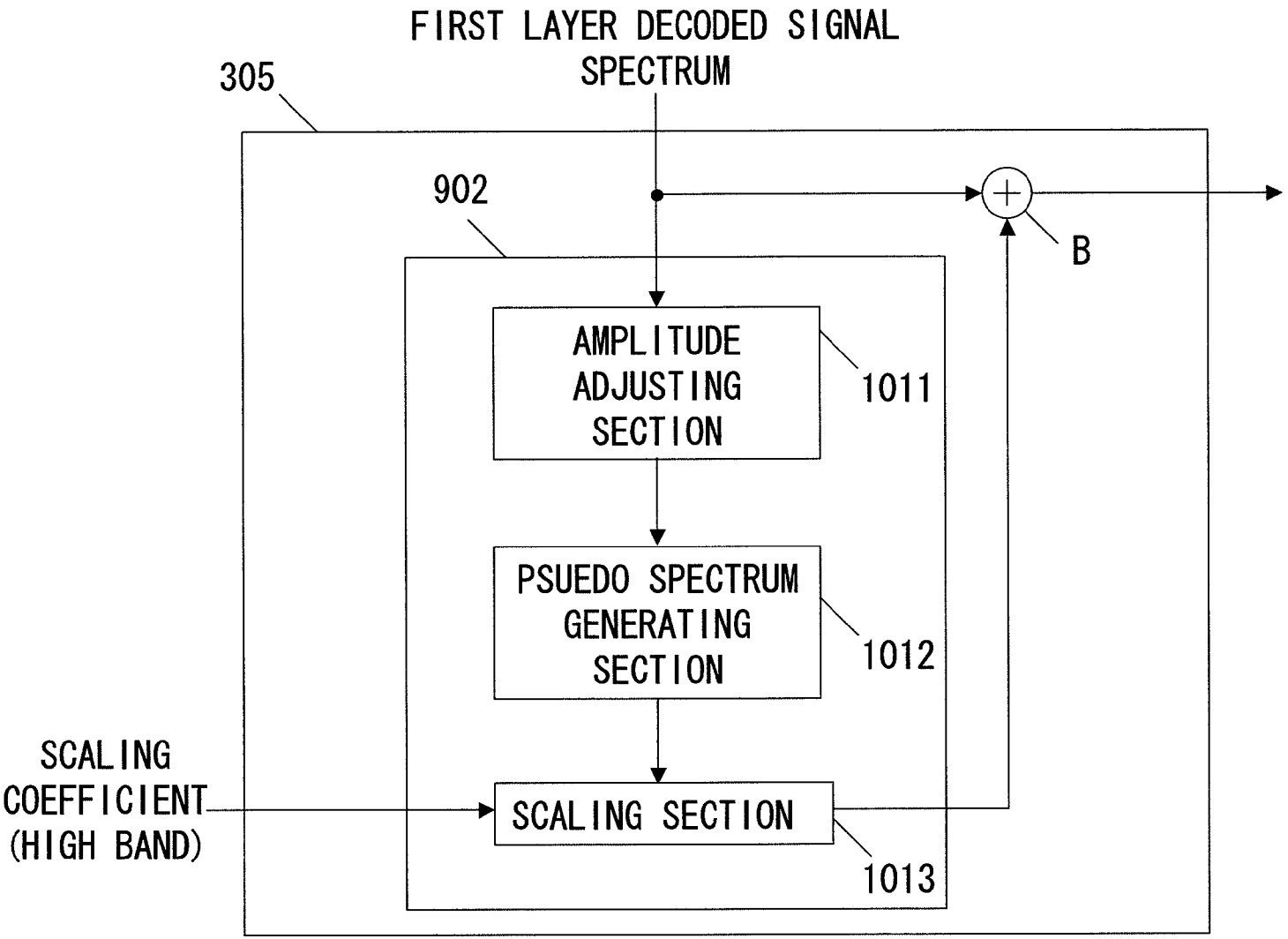
FIG. 10 is yet another block diagram showing a configuration of the spectrum decoding section according to Embodiment 1 of the present invention.

Next, a method for generating a high band spectrum in a pseudo manner will be described using FIG. 9 as an example. In FIG. 9, high spectrum decoding section 902 generates a high band spectrum in a pseudo manner. FIG. 10 shows the configuration of high band spectrum decoding section 902 in more detail.

High band spectrum decoding section 902 of FIG. 10 includes amplitude adjusting section 1011, pseudo spectrum generating section 1012 and scaling section 1013.

Amplitude adjusting section 1011 adjusts the amplitude of the first layer decoded signal spectrum inputted from frequency domain transform section 302 and outputs the result to pseudo spectrum generating section 1012.

Pseudo spectrum generating section 1012 generates a high band spectrum in a pseudo manner using the first layer decoded signal spectrum, whose amplitudes are adjusted, inputted from amplitude adjusting section 1011, and outputs the result to scaling section 1013.

Scaling section 1013 scales the spectrum inputted from pseudo spectrum generating section 1012 and outputs the result to adder B.

Figure 11:
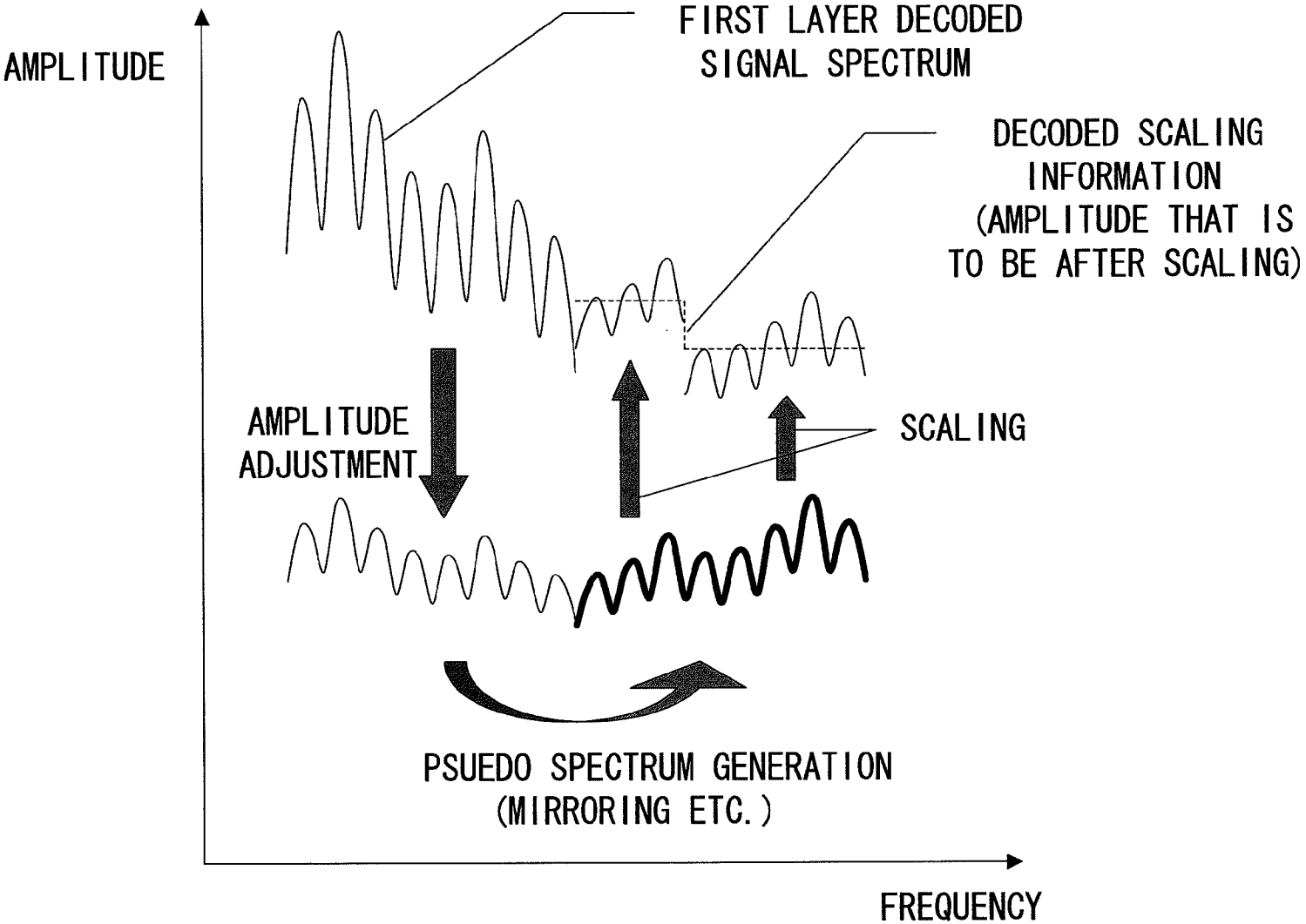
FIG. 11 is a schematic diagram showing processing of generating a high band component at a high band spectrum decoding section according to Embodiment 1 of the present invention.

FIG. 11 is a schematic diagram showing an example of a series of processing of generating a high band spectrum in a pseudo manner.

First, amplitude adjustment of the first layer decoded signal spectrum is carried out. This amplitude adjustment method may be, for example, a constant multiple in a logarithmic domain ($\gamma \times S$, where $\gamma$ is an amplitude adjustment coefficient (real number) in the range of $0 \leqq \gamma \leqq 1$, and S is a logarithmic spectrum), or may be a constant $\gamma$-th power (where $s^{\gamma}$, s are linear spectrum) in a linear domain. Further, it is also possible to use coefficients typified by coefficients necessary in fitting the depth of valleys of harmonics occurring at a low band in a voiced speech into the depth of valleys of harmonics occurring at a high band as adjusting coefficients for the amplitude adjustment. Further, the adjusting coefficients may be a fixed constant, but it is also possible to prepare a plurality of appropriate adjustment coefficients according to an index (for example, directly, a variance of spectrum amplitude occurring at a low band, or indirectly, a value of pitch gain occurring at first layer encoding section 201) indicating a depth of valleys of low band spectrum harmonics, and selectively use corresponding adjustment coefficients according to the index. Further, it is also possible to selectively use adjustment coefficients according to characteristics for each vowel using low band spectrum shape (envelope) information and pitch period information. Further, it is also possible to encode optimum adjustment coefficients on the encoder side as separate transmission information and transmit the encoded information.

Next, a high band spectrum is generated in a pseudo manner using the amplitude adjusted spectrum. As a generating method, an example of mirroring that generates a high band spectrum as a low band mirror image is shown in FIG. 11. In addition to mirroring, there are a method of generating a high band spectrum by shifting the amplitude adjusted spectrum in a high band direction of a frequency axis, and a method of generating a high band spectrum by carrying out pitch filtering processing on the amplitude adjusted spectrum in a frequency axis direction using the pitch lag obtained using the low band spectrum. In either method, it is ensured that the generated high band harmonic structure does not collapse, and that the low band spectrum harmonic structure and the generated high band spectrum harmonic structure are continuously connected.

Finally, a high band spectrum is generated by carrying out amplitude scaling for each coded band.

Figure 12:
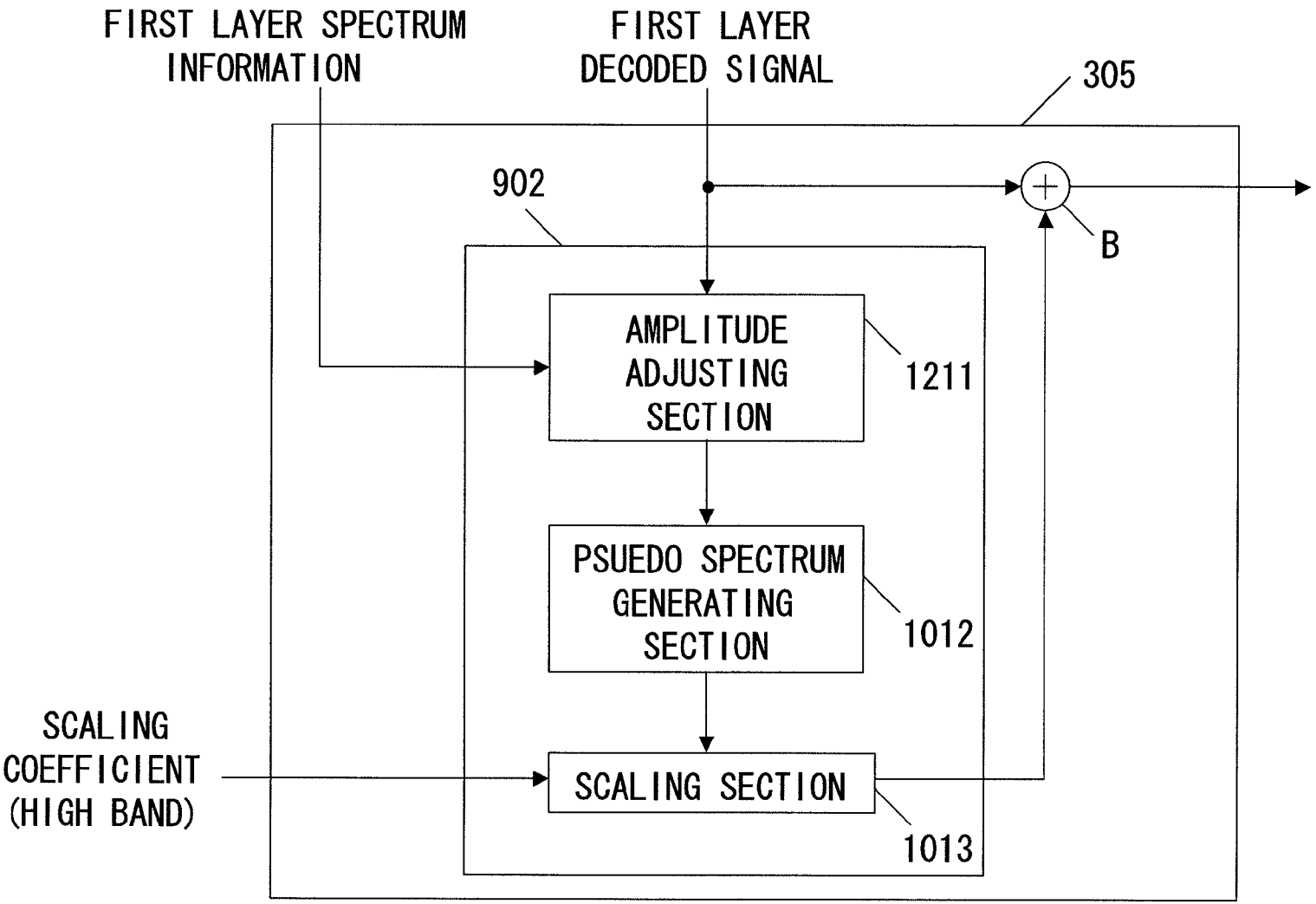
FIG. 12 is yet another block diagram showing a configuration of the spectrum decoding section according to Embodiment 1 of the present invention.

FIG. 12 shows the case where first layer spectrum information (for example, decoding LSP parameters) is inputted to amplitude adjusting section 1211 from first layer decoding section 102. In this case, amplitude adjusting section 1211 decides adjustment coefficients using amplitude coefficients based on the inputted first layer spectrum information. First layer pitch information (i.e. pitch period and/or pitch gain) other than the first layer spectrum information may also be used to decide the adjustment coefficients.

Figure 13:
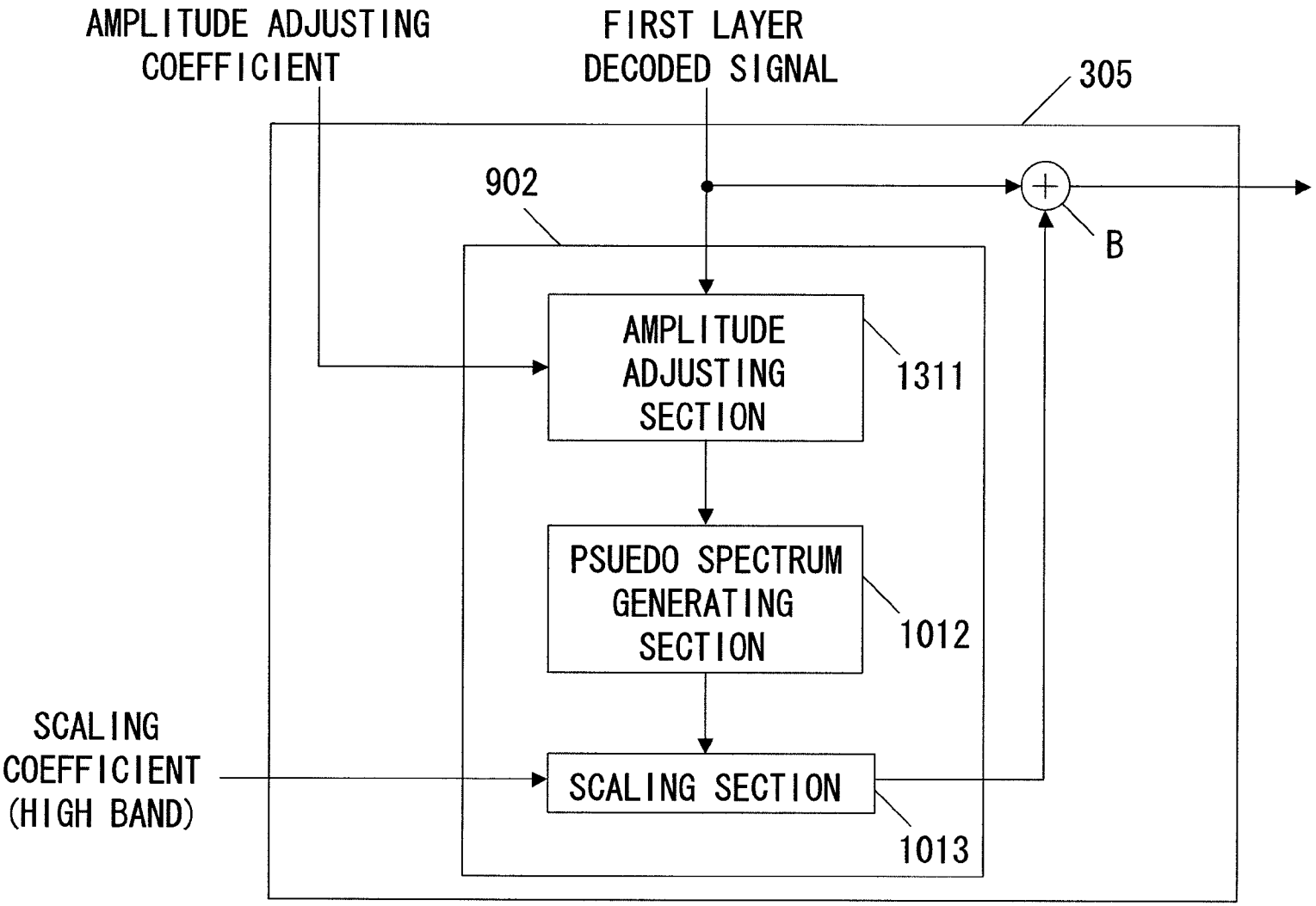
FIG. 13 is another block diagram showing a configuration of the spectrum decoding section according to Embodiment 1 of the present invention.

FIG. 13 shows the case where an amplitude adjustment coefficient is inputted separately. In this case, the amplitude adjustment coefficient is quantized and encoded on the encoder side, and then transmitted.

Embodiment 2

Figure 14:
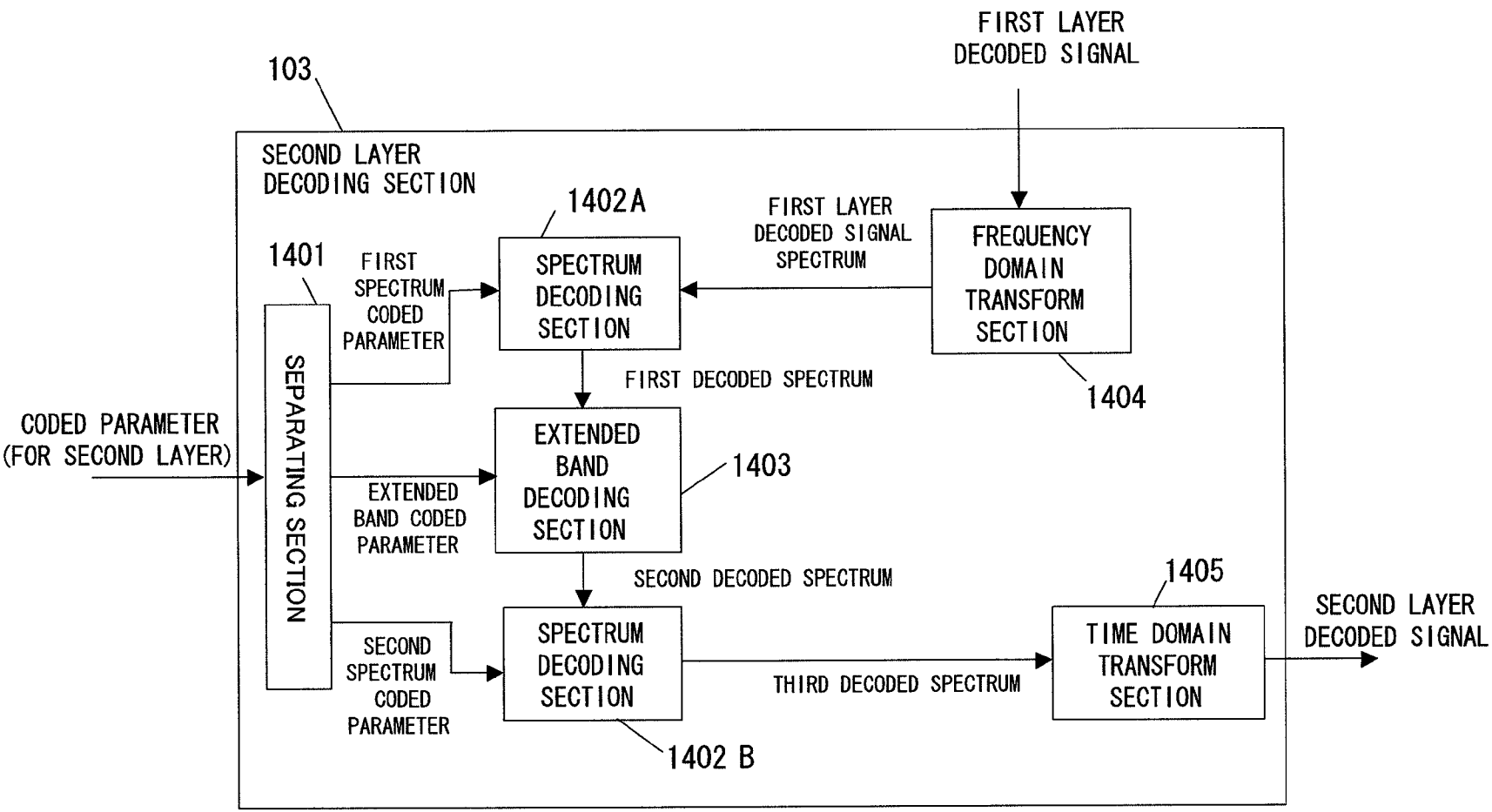
FIG. 14 is a block diagram showing a configuration of a second layer decoding section according to Embodiment 2 of the present invention.

FIG. 14 is a block diagram showing a configuration of second layer decoding section 103 according to Embodiment 2 of the present invention.

Second layer decoding section 103 of FIG. 14 includes separating section 1401, spectrum decoding section 1402, extended band decoding section 1403, spectrum decoding section 1402B, frequency domain transform section 1404 and time domain transform section 1405.

Separating section 1401 separates the second layer coded parameter into a first spectrum coded parameter, an extended band coded parameter and a second spectrum coded parameter, and outputs those parameters to spectrum decoding section 1402A, extended band decoding section 1403 and spectrum decoding section 1402B, respectively.

Frequency domain transform section 1404 transforms a first layer decoded signal inputted from first layer decoding section 102 to a frequency domain parameter (for example, MDCT coefficients) and outputs the result to first spectrum decoding section 1402A as a first layer decoded signal spectrum.

Spectrum decoding section 1402A adds a quantized spectrum of the first layer coding errors, which is obtained by decoding the first spectrum coded parameter inputted from separating section 1401, to the first layer decoded signal spectrum inputted from frequency domain transform section 1404, and outputs the result to extended band decoding section 1403 as the first decoded spectrum. At spectrum decoding section 1402A, the first layer coding errors are improved mainly for the low band component at spectrum decoding section 1402A.

Extended band decoding section 1403 decodes various parameters from the extended band coded parameter inputted from separating section 1401 and decodes/generates a high band spectrum using the various decoded parameters based on the first decoded spectrum inputted from spectrum decoding section 1402A. Extended band decoding section 1403 then outputs a spectrum for the whole band to spectrum decoding section 1402B as the second decoded spectrum.

Spectrum decoding section 1402B adds a spectrum, which is the quantized coding errors of the second decoded spectrum obtained by decoding the second spectrum coded parameter inputted from separating section 1401, to the second decoded spectrum inputted from extended band decoding section 1403, and outputs the result to time domain transform section 1405 as the third decoded spectrum.

Time domain transform section 1405 transforms the third decoded spectrum inputted from spectrum decoding section 1402B to a time domain signal and outputs the result as a second layer decoded signal.

In FIG. 14, it is also possible to adopt a configuration where one or both of spectrum decoding section 1402A and spectrum decoding section 1402B are not present. In the case of a configuration where spectrum decoding section 1402A is not present, the first layer decoded signal spectrum outputted from frequency domain transform section 1404 is inputted to extended band decoding section 1403. Further, in the case of a configuration where spectrum decoding section 1402B is not present, the second decoded spectrum outputted from extended band decoding section 1403 is inputted to time domain transform section 1405.

Figure 15:
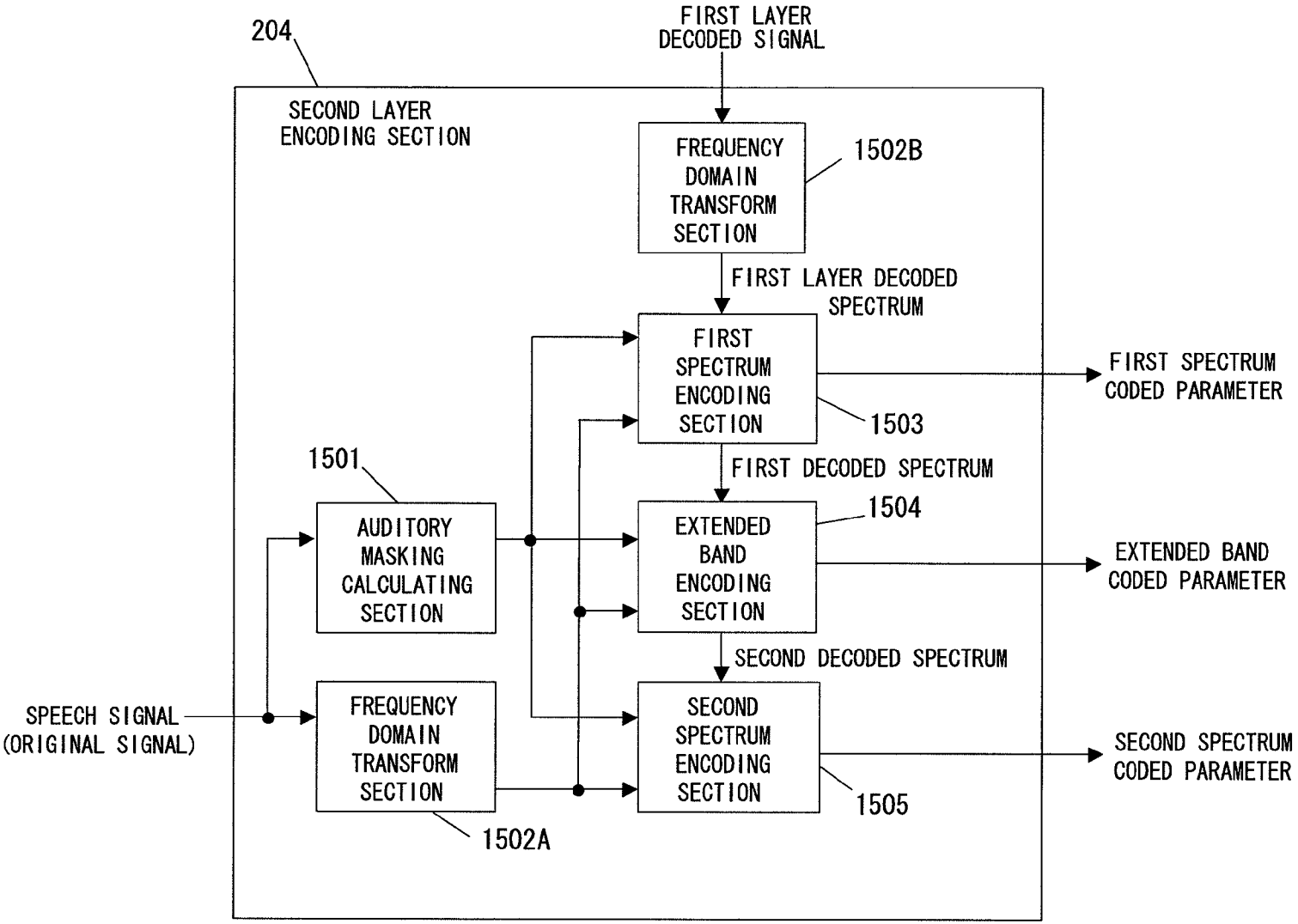
FIG. 15 is a block diagram showing a configuration of a second layer encoding section according to Embodiment 2 of the present invention.

An example of a configuration of second layer encoding section 204 corresponding to second layer decoding section 103 of FIG. 14 is shown in FIG. 15.

In FIG. 15, the speech signal (i.e. original signal) is inputted to auditory masking calculating section 1501 and frequency domain transform section 1502A.

Auditory masking calculating section 1501 calculates auditory masking using the inputted speech signal and outputs the auditory masking to first spectrum encoding section 1503, extended band encoding section 1504 and second spectrum encoding section 1505.

Frequency domain transform section 1502A transforms the inputted speech signal to a frequency domain spectrum parameter (for example, MDCT coefficients), and outputs the result to first spectrum encoding section 1503, extended band encoding section 1504 and second spectrum encoding section 1505.

Frequency domain transform section 1502B transforms the inputted first layer decoded signal to a spectrum parameter such as MDCT and outputs the result to first spectrum encoding section 1503.

First spectrum encoding section 1503 encodes a differential spectrum between the input speech signal spectrum, which is inputted from frequency domain transform section 1502, and the first layer decoded spectrum, which is inputted from frequency domain transform section 1502B, using the auditory masking inputted from auditory masking calculating section 1501, outputs the result as a first spectrum coded parameter, and outputs a first decoded spectrum obtained by decoding the first spectrum coded parameter to extended band encoding section 1504.

Extended band encoding section 1504 encodes an error spectrum between the input speech signal spectrum, which is inputted from frequency domain transform section 1502A, and the first decoded spectrum, which is inputted from first spectrum encoding section 1503, using the auditory masking inputted from auditory masking calculating section 1501, outputs the result as an extended band coding parameter, and outputs the second decoded spectrum obtained by decoding the extended band coded parameter to second spectrum encoding section 1505.

Second spectrum encoding section 1505 encodes an error spectrum between the input speech signal spectrum, which is inputted from frequency domain transform section 1502A, and the second decoded spectrum, which is inputted from extended band encoding section 1504, using the auditory masking inputted from auditory masking calculating section 1501, and outputs the result as a second spectrum coded parameter.

Figure 16:
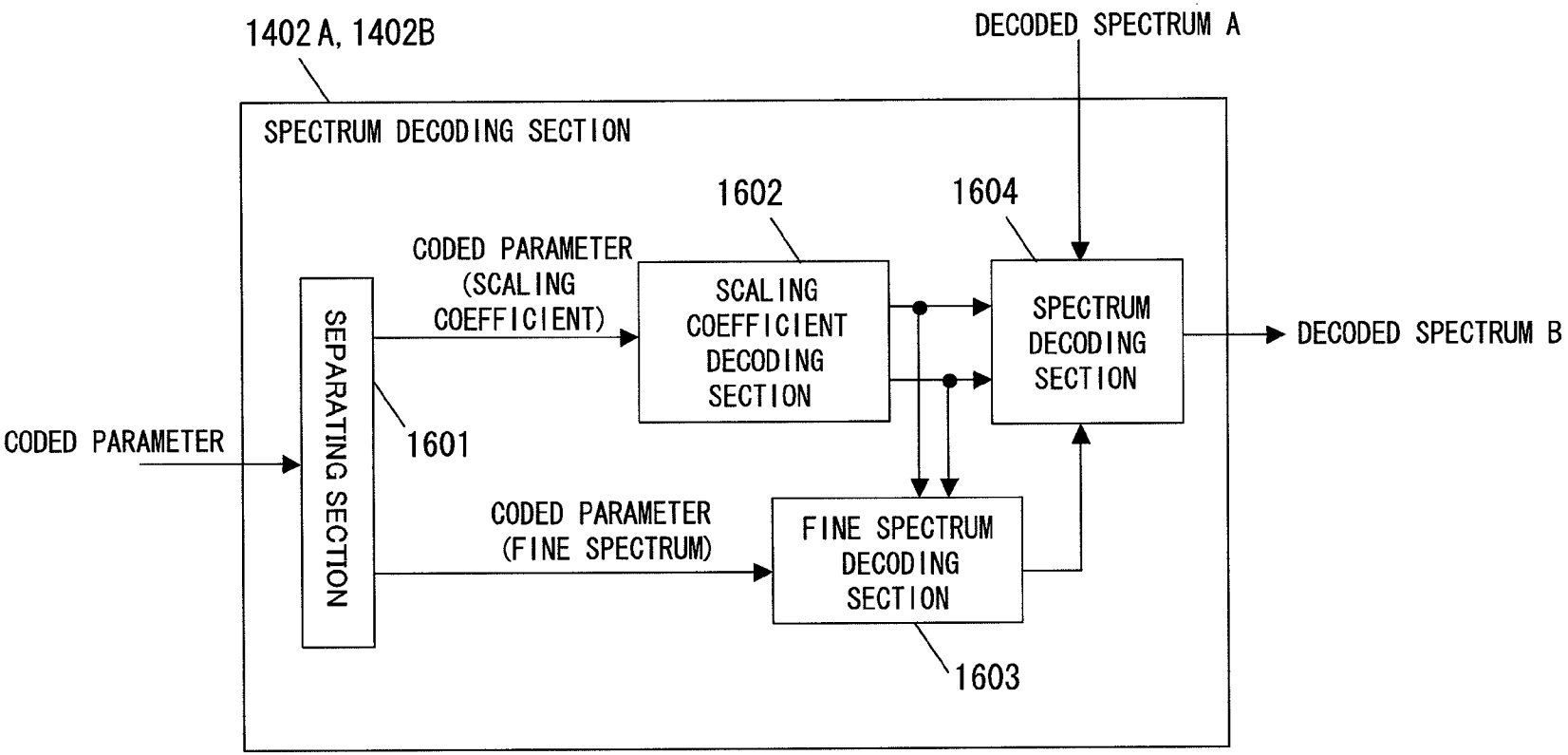
FIG. 16 is another block diagram showing a configuration of the spectrum decoding section according to Embodiment 2 of the present invention.
Figure 17:
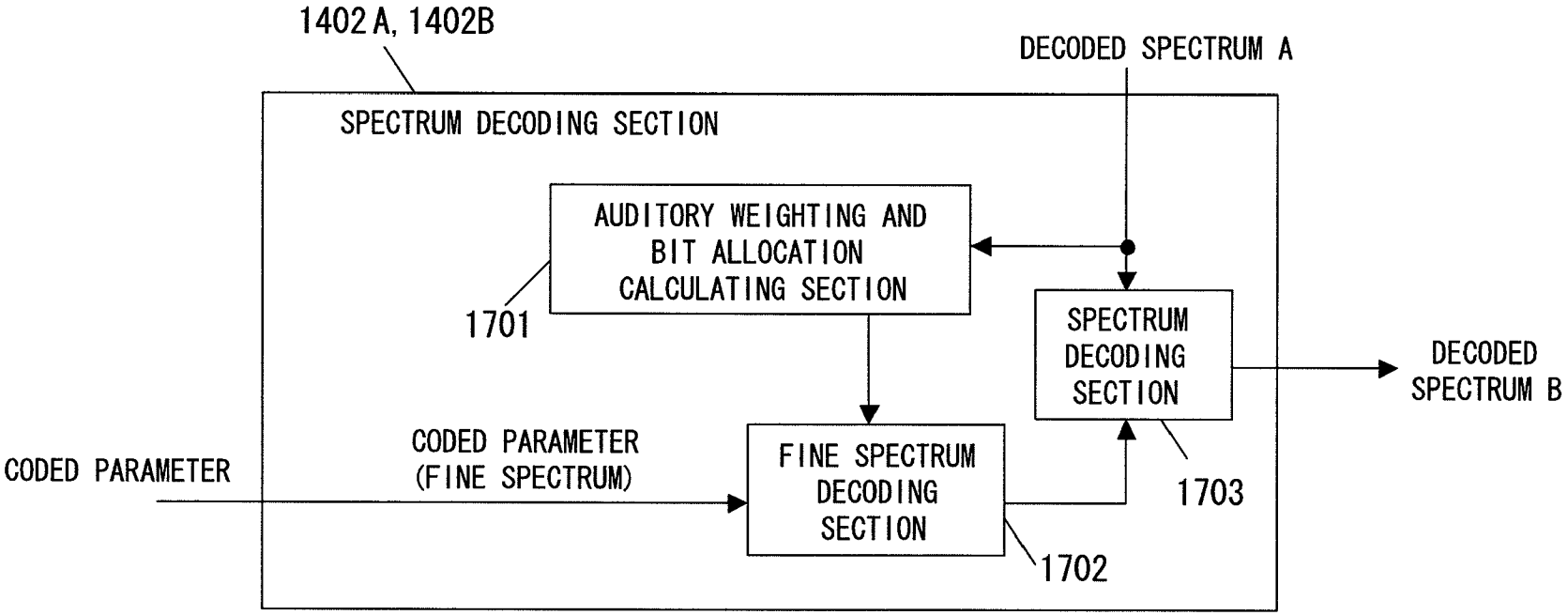
FIG. 17 is yet another block diagram showing a configuration of the spectrum decoding section according to Embodiment 2 of the present invention.

Next, specific examples of spectrum decoding sections 1402A and 1402B of FIG. 14 are shown in FIG. 16 and FIG. 17.

In FIG. 16, separating section 1601 separates the inputted coding parameter into a coding parameter indicating scaling coefficients (i.e. scaling coefficient parameter) and a coding parameter indicating a spectrum fine structure (i.e. fine spectrum parameter), and outputs the parameters to scaling coefficient decoding section 1602 and fine spectrum decoding section 1603, respectively.

Scaling coefficient decoding section 1602 decodes the inputted scaling coefficient parameter so as to obtain low band scaling coefficients and high band scaling coefficients, outputs the decoding scaling coefficients to spectrum decoding section 1604 and fine spectrum decoding section 1603.

Fine spectrum decoding section 1603 calculates auditory weighting of each band using the scaling coefficients inputted from scaling coefficient decoding section 1602 and obtains the number of bits allocated to fine spectrum information of each band. Fine spectrum decoding section 1603 then decodes the fine spectrum parameter inputted from separating section 1601 and obtains decoded fine spectrum information of each band, and outputs the decoded fine spectrum information to spectrum decoding section 1604. It is also possible to use information for decoded spectrum A in calculation of auditory weighting. In this case, a configuration is adopted so that decoded spectrum A is inputted to fine spectrum decoding section 1603.

Spectrum decoding section 1604 then decodes decoded spectrum B from inputted decoded spectrum A, decoded scaling coefficients (for low band and high band) inputted from scaling coefficient decoding section 1602, and decoded fine spectrum information inputted from fine spectrum decoding section 1603.

The relationship of correspondence between FIG. 16 and FIG. 14 is described as follows. When the configuration shown in FIG. 16 is a configuration of spectrum decoding section 1402, the coding parameter of FIG. 16 corresponds to the first spectrum coded parameter of FIG. 14, decoded spectrum A of FIG. 16 corresponds to the first layer decoded signal spectrum of FIG. 14, and decoded spectrum B of FIG. 16 corresponds to the first decoded spectrum of FIG. 14. Further, if the configuration shown in FIG. 16 is a configuration for spectrum decoding section 1402B, the coding parameter of FIG. 16 corresponds to the second spectrum coded parameter of FIG. 14, decoded spectrum A of FIG. 16 corresponds to the second decoded spectrum of FIG. 14, and decoded spectrum B of FIG. 16 corresponds to the third decoded spectrum of FIG. 14.

Figure 18:
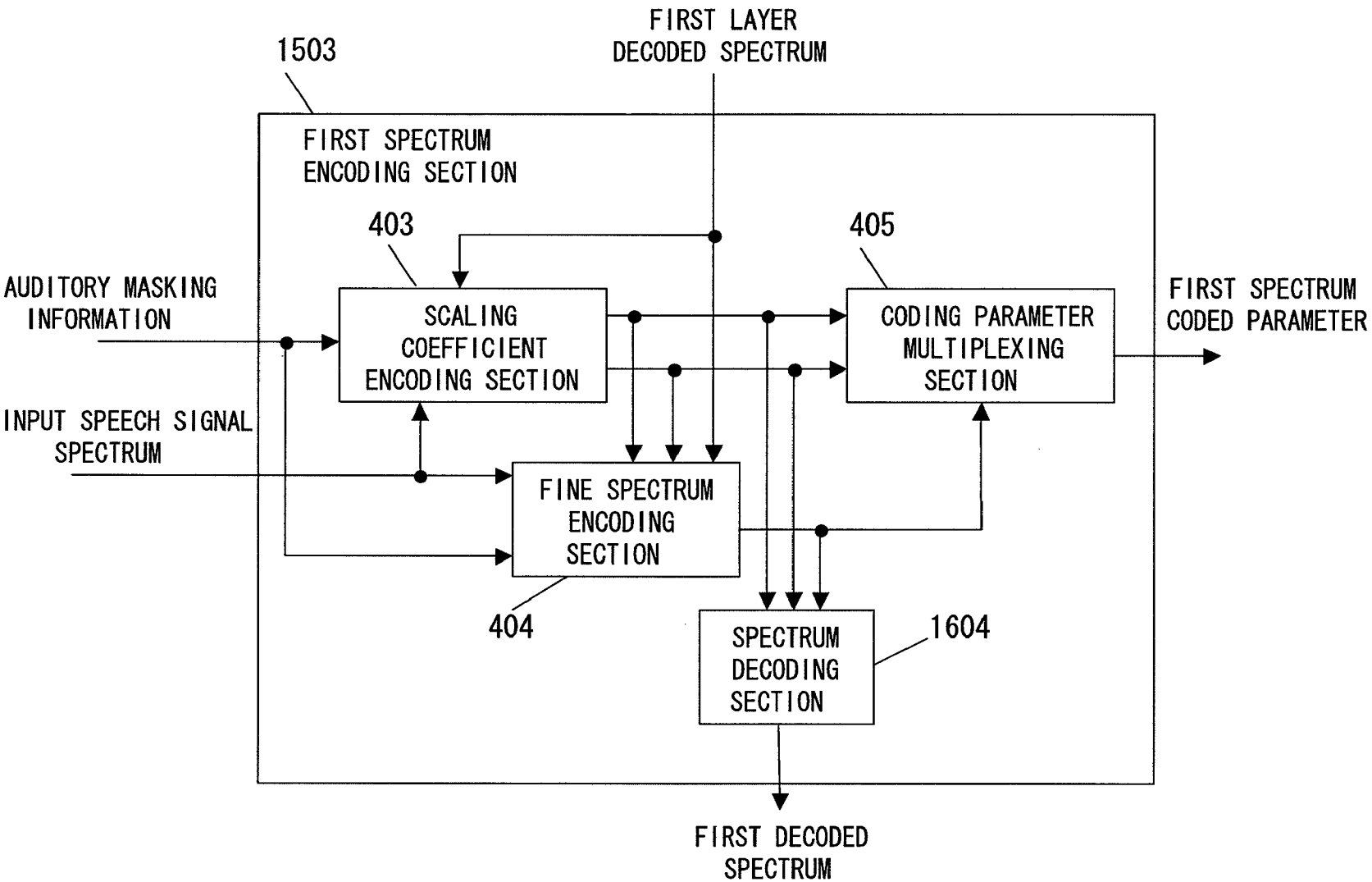
FIG. 18 is a block diagram showing a configuration of a first spectrum encoding section according to Embodiment 2 of the present invention.

An example of configuration of first spectrum encoding section 1503, which is corresponding to spectrum decoding sections 1402A and 1402B of FIG. 16, is shown in FIG. 18. In FIG. 18, the configuration of first spectrum encoding section 1503 in FIG. 15 is shown. First spectrum encoding section 1503 shown in FIG. 18 is configured with scaling coefficient encoding section 403, fine spectrum encoding section 404, coding parameter multiplexing section 405 shown in FIG. 4 and spectrum decoding section 1604 shown in FIG. 16. The operation thereof is the same as described in FIG. 4 and FIG. 16, and therefore the description thereof will be omitted here. Further, if the first layer decoded spectrum of FIG. 18 is replaced with the second decoded spectrum, and the first spectrum coded parameter is replaced with the second spectrum coded parameter, the configuration shown in FIG. 18 is a configuration of second spectrum encoding section 1505 in FIG. 15. Spectrum decoding section 1604 can be eliminated in the configuration of second spectrum encoding section 1505.

FIG. 17 shows a configuration of spectrum decoding sections 1402A and 1402B in the case of not using scaling coefficients. In this case, spectrum decoding sections 1402A and 1402B include auditory weighting and bit allocation calculating section 1701, fine spectrum decoding section 1702 and spectrum decoding section 1703.

In FIG. 17, auditory weighting and bit allocation calculating section 1701 obtains auditory weighting of each band from inputted decoded spectrum A, and obtains bit allocation to each band decided according to the auditory weighting. Information of the obtained auditory weighting and bit allocation is then outputted to fine spectrum decoding section 1702.

Fine spectrum decoding section 1702 then decodes inputted coded parameters based on the auditory weighting and bit allocation information, which are inputted from auditory weighting and bit allocation calculating section 1701, and obtains decoded fine spectrum information of each band, and outputs the decoded fine spectrum information to spectrum decoding section 1703.

Spectrum decoding section 1703 then adds fine spectrum decoding information, which is inputted from fine spectrum decoding section 1702, to inputted decoded spectrum A, and outputs the result as decoded spectrum B.

The relationship of correspondence between FIG. 17 and FIG. 14 is described as follows. When the configuration shown in FIG. 17 is a configuration of spectrum decoding section 1402, the coding parameter of FIG. 17 corresponds to the first spectrum coded parameter of FIG. 14, decoded spectrum A of FIG. 17 corresponds to the first layer decoded signal spectrum of FIG. 14, and decoded spectrum B of FIG. 17 corresponds to the first decoded spectrum of FIG. 14. Further, if the configuration shown in FIG. 17 is a configuration of spectrum decoding section 1402B, the coding parameter of FIG. 17 corresponds to the second spectrum coded parameter of FIG. 14, decoded spectrum A of FIG. 17 corresponds to the second decoded spectrum of FIG. 14, and decoded spectrum B of FIG. 17 corresponds to the third decoded spectrum of FIG. 14.

As with the correspondence between FIG. 16 and FIG. 18, it is also possible to configure first spectrum encoded section corresponding to spectrum decoding sections 1402A and 1402B of FIG. 17.

Next, the details of extended band decoding section 1403 shown in FIG. 14 will be described using FIG. 19 to FIG. 23.

Figure 19:
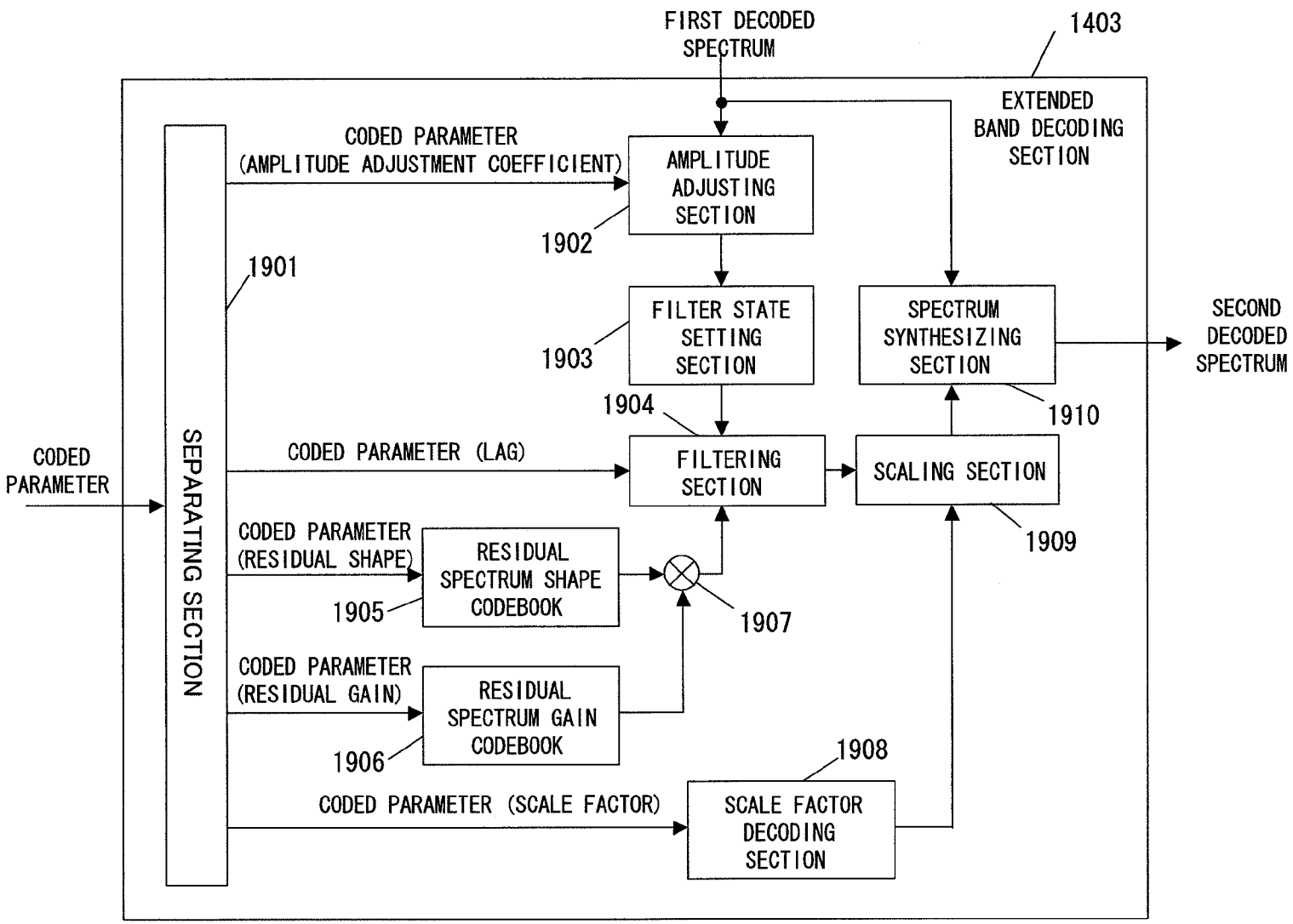
FIG. 19 is a block diagram showing a configuration of an extended band decoding section according to Embodiment 2 of the present invention.

FIG. 19 is a block diagram showing a configuration of extended band decoding section 1403. In FIG. 19, extended band decoding section 1403 includes separating section 1901, amplitude adjustment section 1902, filter state setting section 1903, filtering section 1904, residual spectrum shape codebook 1905, residual spectrum gain codebook 1906, multiplier 1907, scale factor decoding section 1908, scaling section 1909 and spectrum synthesizing section 1910.

Separating section 1901 separates the coded parameter inputted from separating section 1401 of FIG. 14 into an amplitude adjustment coefficient coding parameter, a lag coding parameter, a residual shape coding parameter, a residual gain coding parameter and a scale factor coding parameter, and outputs the parameters to amplitude adjusting section 1902, filtering section 1904, residual spectrum shape codebook 1905, residual spectrum gain codebook 1906 and scale factor decoding section 1908, respectively.

Amplitude adjusting section 1902 decodes the coded amplitude adjustment coefficient parameter inputted from separating section 1901, adjusts the amplitude of the first layer decoded spectrum inputted from spectrum decoding section 1402 of FIG. 14, and outputs a first decoded spectrum, whose amplitude is adjusted, to filter state setting section 1903. Amplitude adjustment is carried out using a method expressed by $\{S(n)\}^{\gamma}$, when, for example, the first decoded spectrum is assumed to be S(n), and the amplitude adjustment coefficient is assumed to be $\gamma$. Here, S(n) is spectrum amplitude in the linear domain, and n is a frequency.

Filter state setting section 1903 sets the first decoded spectrum, whose amplitude is adjusted, to the filter state of the pitch filter as expressed by transfer function $P(z)=(1-z^{-T})-1$. Specifically, filter state setting section 1903 substitutes first decoded spectrum, whose amplitude is adjusted and which is denoted by S1 [0 to Nn], in generated spectrum buffer S [0 to Nn], and outputs the substituted generated spectrum buffer to filtering section 1904. Here, z is a variable occurring in z transform. $z^{-1}$ is a complex variable referred to as a delay operator. Further, T is a lag for the pitch filter, Nn is the number of valid spectrum points for the first decoded spectrum (corresponding to the upper limit frequency of the spectrum used as a filter state), and generated spectrum buffer S[n] is an array variable defined in the range of n=0 to Nw. Further, Nw is the number of spectrum points after bandwidth extention, and a spectrum with (Nw-Nn) points is generated by this filtering processing.

Filtering section 1904 carries out filtering processing on generated spectrum buffer S[n] inputted from filter state setting section 1903 using lag coding parameter T inputted from separating section 1901. Specifically, filtering section 1904 generates S[n] using S[n]=S[n−T]+gC[n], where n=Nn to Nw. Here, g indicates residual spectrum gain, C[n] indicates a residual spectrum shape vector, and gC[n] is inputted from multiplier 1907. Generated S[Nn to Nw] is outputted to scaling section 1909.

Residual spectrum shape codebook 1905 decodes the residual shape coding parameter inputted from separating section 1901 and outputs a residual spectrum shape vector corresponding to the decoding result to multiplier 1907.

Residual spectrum gain codebook 1906 decodes the residual gain coding parameter inputted from separating section 1901 and outputs residual gain corresponding to the decoding result to multiplier 1907.

Multiplier 1907 outputs result gC[n] of multiplying residual spectrum shape vector C[n] inputted from residual spectrum shape codebook 1905 by residual gain g inputted from residual spectrum gain codebook 1906 to filtering section 1904.

Scale factor decoding section 1908 decodes the scale factor coding parameter inputted from separating section 1901 and outputs the decoded scale factor to scaling section 1909.

Scaling section 1909 multiplies the scale factor inputted from scale factor decoding section 1908 by spectrum S[Nn to Nw] inputted from filtering section 1904, and outputs the result to spectrum synthesizing section 1910.

Spectrum synthesizing section 1910 substitutes the first decoded spectrum inputted from spectrum decoding section 1402A of FIG. 14 for the low band (S[0 to Nn]) and substitutes the spectrum inputted from scaling section 1909 for the high band (S[Nn to Nw]) and outputs the obtained spectrum to spectrum decoding section 1402B of FIG. 14 as a second decoded spectrum.

Figure 20:
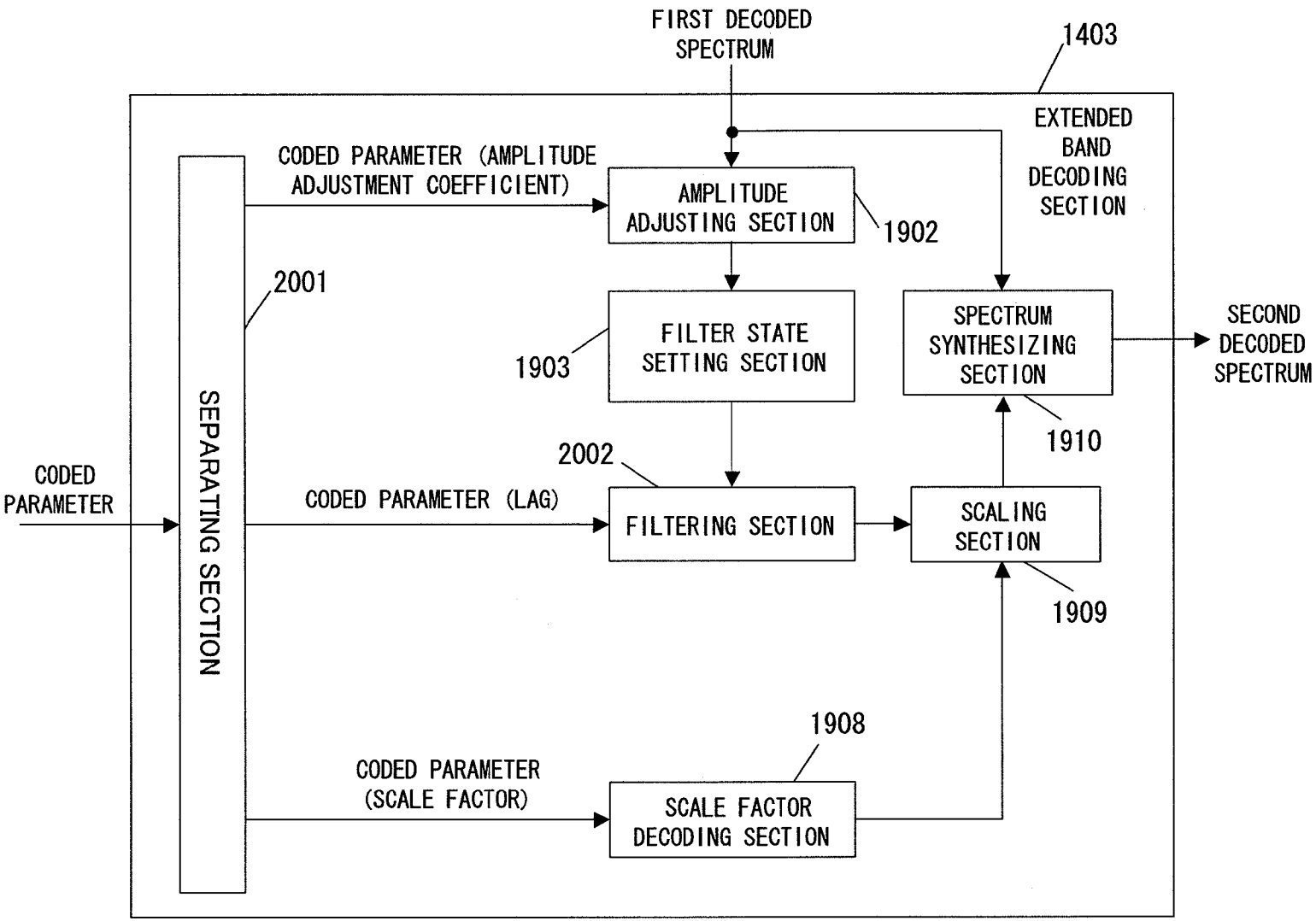
FIG. 20 is a further block diagram showing a configuration of the extended band decoding section according to Embodiment 2 of the present invention.

Next, a configuration of extended band decoding section 403 for the case where the spectrum differential shape coding parameter and the residual spectrum gain coding parameter cannot be received completely is shown in FIG. 20. In this case, information of a coded parameter for an amplitude adjustment coefficient, a coded lag parameter and a coded scale factor parameter can be received completely.

In FIG. 20, the configuration other than for separating section 2001 and filtering section 2002 is the same as for each part of FIG. 19 and is therefore not described.

In FIG. 20, separating section 2001 separates the coded parameter inputted from separating section 1401 of FIG. 14 into an amplitude adjustment coefficient parameter, a coded lag parameter and a coded scale factor parameter, and outputs those parameters to amplitude adjusting section 1902, filtering section 2002 and scale factor decoding section 1908, respectively.

Filtering section 2002 carries out filtering processing on generated spectrum buffer S[n] inputted from filter state setting section 1903 using the coded lag parameter inputted from separating section 2001. Specifically, filtering section 2002 generates S[n] using S[n]=S[n−T], where n=Nn to Nw. Generated S[Nn to Nw] is outputted to scaling section 1909.

Figure 21:
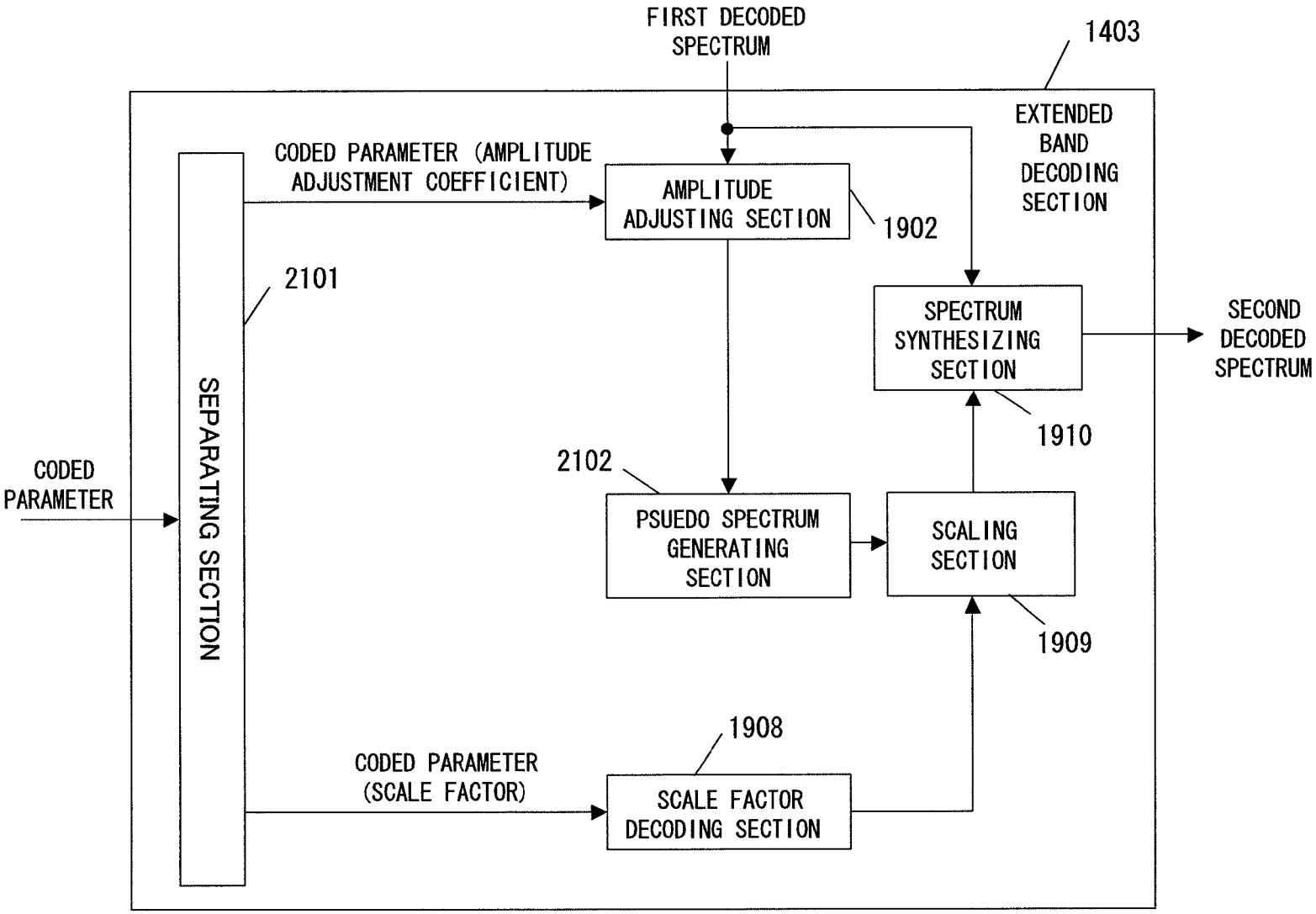
FIG. 21 is a yet further block diagram showing a configuration of the extended band decoding section according to Embodiment 2 of the present invention.

Next, a configuration of extended band decoding section 1403 for the case where the coded lag parameter can also not be received is shown in FIG. 21. In this case, information of a coded parameter for an amplitude adjustment coefficient and a coded scale factor parameter can be received completely.

In FIG. 21, filter state setting section 1903 of FIG. 20 and filtering section 2002 are substituted with pseudo spectrum generating section 2102. In FIG. 21, the configuration other than for separating section 2101 and pseudo spectrum generating section 2102 is the same as for each part of FIG. 19 and is therefore not described.

In FIG. 21, separating section 2101 separates the coding parameter inputted from separating section 1401 of FIG. 14 into a coded amplitude adjustment coefficient parameter and a coded scale factor parameter, and outputs those parameters to amplitude adjusting section 1902 and scale factor decoding section 1908, respectively.

Pseudo spectrum generating section 2102 generates a high band spectrum in a pseudo manner using the first decoded signal spectrum, whose amplitude is adjusted, inputted from amplitude adjusting section 1902, and outputs the spectrum to scaling section 1909. As a specific method of generating a high band spectrum, there are a method based on mirroring that generates a high band spectrum as a mirror image of a low band spectrum, a method of shifting the amplitude adjusted spectrum in a high band direction of the frequency axis, and a method of carrying out pitch filtering processing in a frequency axis direction on the amplitude adjusted spectrum using the pitch lag obtained from a low band spectrum. It is also possible to generate a pseudo spectrum using a noise spectrum generated in a random manner when decoded frames are determined to be unvoiced frames.

Figure 22:
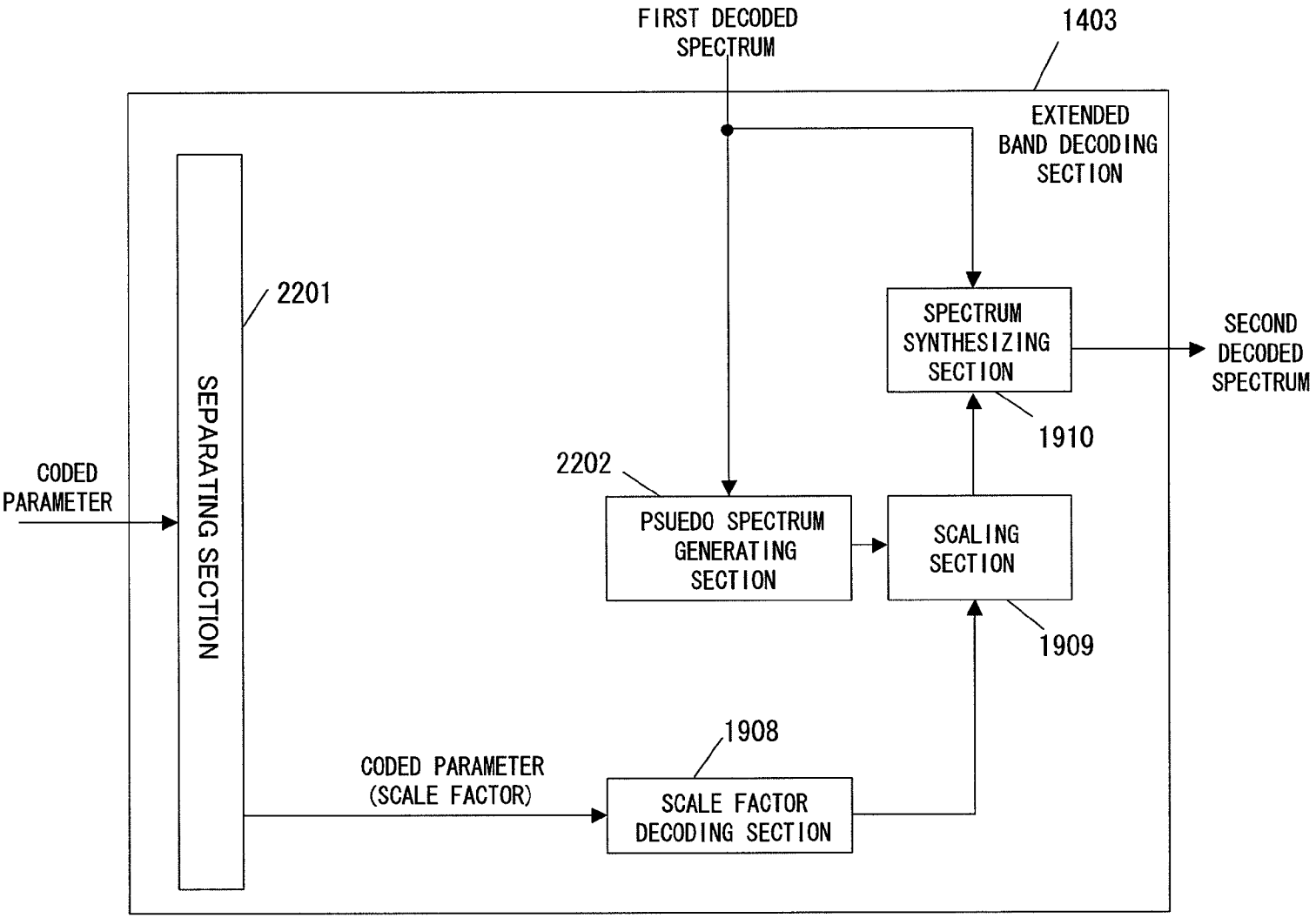
FIG. 22 is another block diagram showing a configuration of the extended band decoding section according to Embodiment 2 of the present invention.

Next, a configuration of extended band decoding section 1403 for the case where amplitude adjustment information can also not be received is shown in FIG. 22. In this case, information of a coded scale factor parameter can be received completely. In FIG. 22, the configuration other than for separating section 2201 and pseudo spectrum generating section 2202 is the same as for each part of FIG. 19 and is therefore not described.

In FIG. 22, separating section 2201 separates the coded scale factor parameter from the coded parameter inputted from separating section 1401 of FIG. 14, and outputs the parameter to scale factor decoding section 1908.

Pseudo spectrum generating section 2202 generates a high band spectrum in a pseudo manner using the first decoded signal spectrum and outputs the spectrum to scaling section 1909. As a specific method of generating a high band spectrum, there are a method based on mirroring that generates a high band spectrum as a mirror image of a low band spectrum, a method of shifting the amplitude adjusted spectrum in a high band direction of the frequency axis, and a method of carrying out pitch filtering processing in a frequency axis direction on the amplitude adjusted spectrum using the pitch lag obtained from a low band spectrum. It is also possible to generate a pseudo spectrum using noise spectrum generated in a random manner when decoded frames are determined to be unvoiced frames. Further, the amplitude adjustment method may be, for example, a constant multiple in a logarithmic domain ($\gamma \times S$, where S is a logarithmic spectrum), or may be a constant $\gamma$-th power (where $s^{\gamma}$, s are linear spectrum) in a linear domain. Further, it is also possible to use coefficients typified by coefficients necessary in fitting the depth of valleys of harmonics occurring at a low band in a voiced speech to the depth of valleys of harmonics occurring at a high band as adjusting coefficients for amplitude adjustment. Further, the adjusting coefficients may be a fixed constant, but it is also possible to prepare a plurality of appropriate adjusting coefficients according to an index (for example, directly, a variance value of a spectrum amplitude occurring at a low band, or indirectly, a value of pitch gain occurring at first layer encoding section 201) indicating a depth of valleys of low band spectrum harmonics, and selectively use the corresponding adjustment coefficients according to the index. Further, it is also possible to selectively use adjusting coefficients according to characteristics for each vowel using low band spectrum shape (envelope) information and pitch period information. More specifically, this is the same as the generation of pseudo spectrum described in Embodiment 1 and is therefore not described here.

Figure 23:
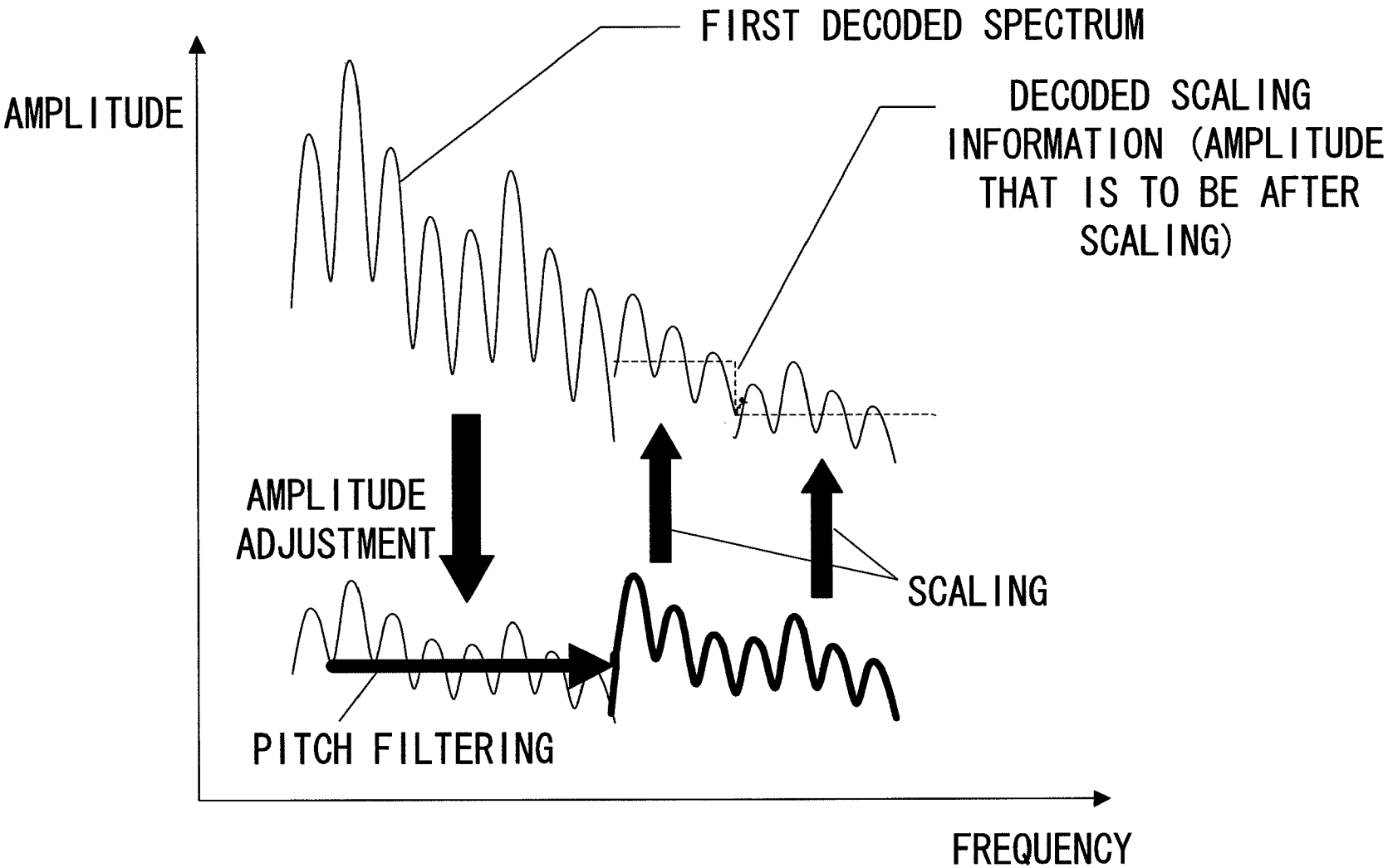
FIG. 23 is a schematic diagram showing processing of generating a high band component at a second extended band decoding section according to Embodiment 1 of the present invention.

FIG. 23 is a schematic diagram showing a series of operations for generating a high band component in the configuration of FIG. 20. As shown in FIG. 23, first, amplitude adjustment of the first decoded spectrum is carried out. Next, filtering processing (pitch filtering) is carried out in a frequency axis direction using first decoded spectrum whose amplitude is adjusted as a filter state of the pitch filter, and a high band component is generated. After this, scaling is carried out on the generated high band component for each scaling coefficient band so as to finally generate a high band spectrum. The second decoded spectrum is then generated by combining the generated high band spectrum and first decoded spectrum.

Figure 24:
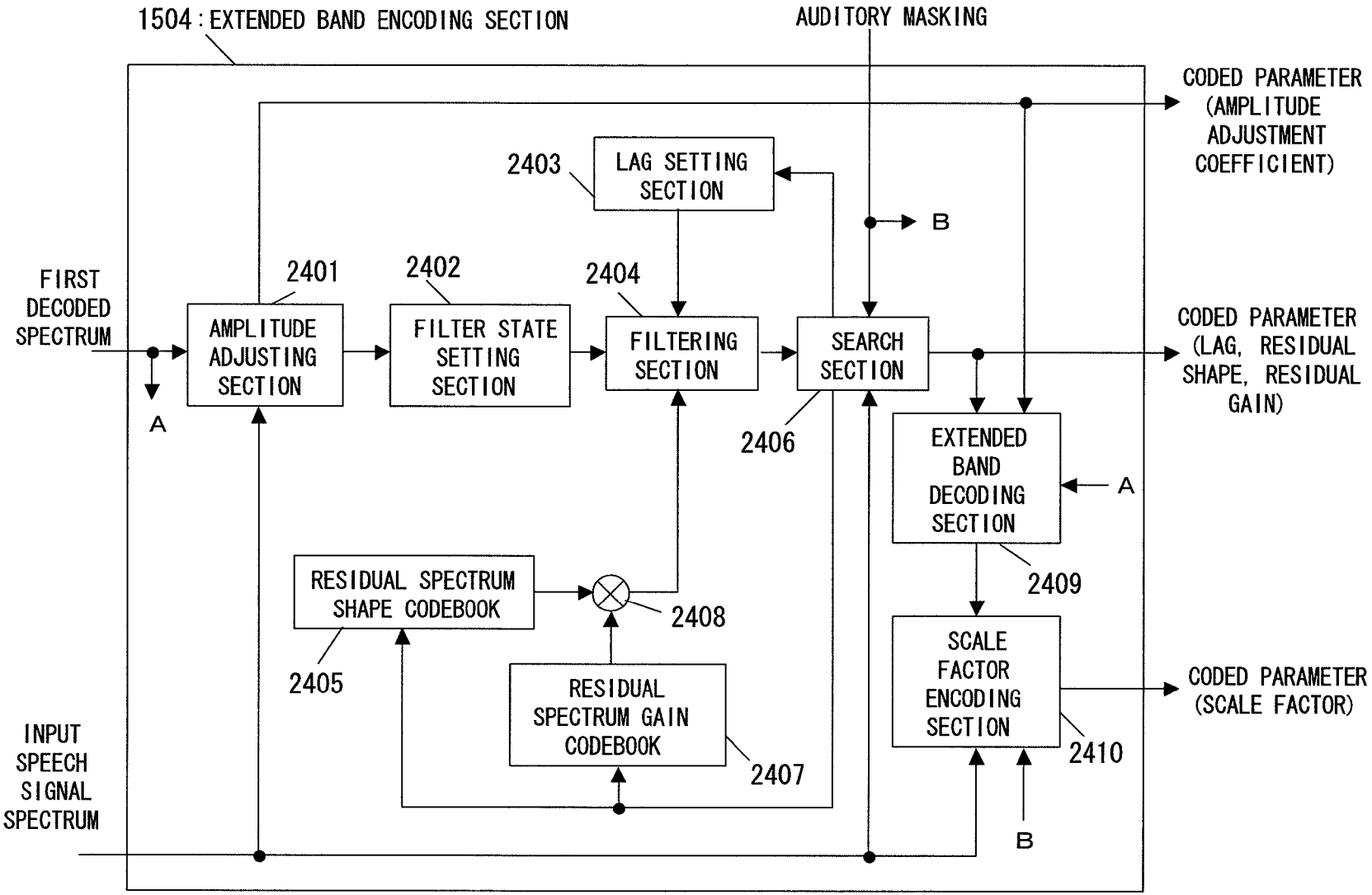
FIG. 24 is a block diagram showing a configuration of an extended band encoding section according to Embodiment 2 of the present invention.

An example of a configuration for extended band encoding section 1504 corresponding to extended band decoding section 1403 of FIG. 19 is shown in FIG. 24.

In FIG. 24, amplitude adjusting section 2401 carries out amplitude adjustment of the first decoded spectrum inputted from first spectrum encoding section 1503 using the input speech signal spectrum inputted from frequency domain transform section 1502A, outputs a coded parameter for the amplitude adjustment coefficient, and outputs first decoded spectrum, whose amplitude is adjusted, to filter state setting section 2402. Amplitude adjusting section 2401 carries out amplitude adjustment processing so that the ratio of the maximum amplitude spectrum of the first decoded spectrum to the minimum amplitude spectrum (i.e. dynamic range) is approximated to the dynamic range of the high band of the input speech signal spectrum. For example, as an amplitude adjusting method, there is the above-described method. Further, it is also possible to carry out amplitude adjustment using, for example, transform equation as shown in equation 1. S1 is a spectrum before transform, and S1' is a spectrum after transform.

[1]

$$S1'(k)=\text{sign}(S1(k))\cdot|S1(k)|^{\gamma} \quad \text{(Equation 1)}$$

Here, sign ( ) is a function returning a positive sign/negative sign, and γ is a real number in the range of $0 \leqq \gamma \leqq 1$. In the case of using equation 1, amplitude adjusting section 2401 selects an amplitude adjustment coefficient γ from a plurality of candidates prepared in advance so that the dynamic range of the first decoded spectrum, whose amplitude is adjusted, becomes closest to the dynamic range of the high band of the input speech signal spectrum, and outputs the coding parameter for the selected amplitude adjustment coefficient γ to multiplexing section 203.

Filter state setting section 2402 sets the first decoded spectrum, whose amplitude is adjusted, inputted from amplitude adjusting section 2401 to the internal state of the pitch filter as with the filter state setting section 1903 of FIG. 19.

Lag setting section 2403 outputs lag T sequentially to filtering section 2404 while gradually changing lag T within a predetermined search range TMIN to TMAX.

Residual spectrum shape codebook 2405 stores a plurality of residual shape vector candidates and sequentially selects and outputs residual spectrum shape vectors from all candidates or candidates restricted in advance, according to the instruction from search section 2406. Similarly, residual spectrum gain codebook 2407 stores a plurality of residual vector gain candidates and sequentially selects and outputs the residual spectrum vector gains from all candidates or candidates restricted in advance, according to the instruction from search section 2406.

Candidates for residual shape vectors outputted from residual spectrum shape codebook 2405 and candidates for residual spectrum gains outputted from residual spectrum gain codebook 2407 are multiplied by multiplying section 2408, and the multiplication result is outputted to filtering section 2404.

Filtering section 2404 then carries out filtering processing using the internal state of the pitch filter set at filter state setting section 2402, lag T outputted from lag setting section 2403, and gain-adjusted residual spectrum shape vectors, and calculates an estimation value for the input speech signal spectrum. This operation is the same as the operation of filtering section 1904 of FIG. 19.

Search section 2406 decides a combination where the cross-correlation between the high band of the input speech signal spectrum (i.e. original spectrum) and the output signal of filtering section 240 becomes a maximum out of a plurality of combinations of lags, residual spectrum shape vectors and residual spectrum gains, using analysis by synthesis (AbS). At this time, the combination that gives the closest one from an auditory point of view is decided utilizing auditory masking. Further, searching is also carried out taking into consideration scaling carried out by a scale factor at a later stage. A coded parameter of lags decided by search section 2406, coded parameter for residual spectrum shape vectors, and coding parameter for residual spectrum gains are outputted to multiplexing section 203 and extended band decoding section 2409.

In the coding parameter deciding method using AbS described above, it is preferable to decide pitch coefficients, residual spectrum shape vectors and residual spectrum gains at the same time. Further, it is also possible to decide sequentially in the order of pitch coefficients T, residual spectrum shape vectors, and residual spectrum gains in order to reduce the amount of calculation.

Extended band decoding section 2409 then carries out decoding processing on the first decoded spectrum using the coded parameter for an amplitude adjustment coefficient outputted from amplitude adjusting section 2401, the coded lag parameter outputted from search section 2406, the coded parameter for residual spectrum shape vectors and coded parameter for residual spectrum gains, generates an estimated spectrum (that is, spectrum before scaling) for the input speech signal spectrum, and outputs the spectrum to scale factor encoding section 2410. The decoding procedure is the same as for extended band decoding section 1403 of FIG. 19 (however, processing for scaling section 1909 and spectrum synthesizing section 1910 is eliminated).

Scale factor encoding section 2410 encodes the scale factor (i.e. scaling coefficients) of the estimated spectrum most appropriate from a perceptual point of view using the high band of the input speech signal spectrum (i.e. original spectrum) outputted from frequency domain transform section 1502A, the estimated spectrum outputted from extended band decoding section 2409, and auditory masking, and outputs the coding parameter to multiplexing section 203.

Figure 25:
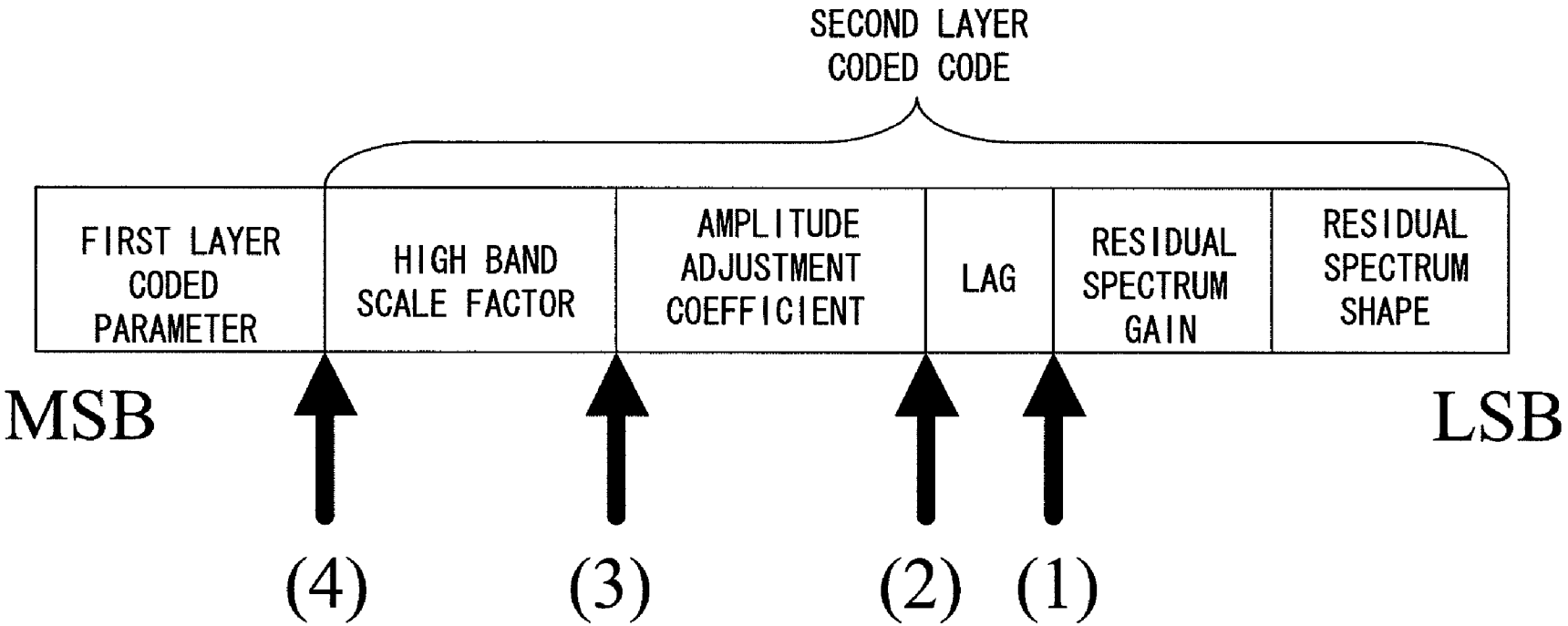
FIG. 25 is a schematic diagram showing the content of a bitstream received by the separating section of the scalable decoding apparatus according to Embodiment 2 of the present invention.

FIG. 25 is a schematic diagram showing content of a bitstream received by separating section 101 of FIG. 1. As shown in the drawings, in bitstreams, a plurality of coding parameters are time-multiplexed. Further, in FIG. 25, the MSB (Most Significant Bit, the most significant bit in the bitstream) is on the left side, and the LSB (Least Significant Bit, the least significant bit in the bitstream) is on the right side. As a result of lining up coding parameters in this way, when the bitstream is partially discarded on the transmission path, by discarding in order from the LSB side, it is possible to minimize quality degradation due to discarding. It is possible to carry out decoding processing using the methods described respectively using FIG. 20 for the case of discarding from the LSB to (1), FIG. 21 for the case of discarding from the LSB to (2), and FIG. 22 for the case of discarding from the LSB to (3). Further, in the case of discarding from LSB to (4), the first layer decoded signal is assumed to be an output signal.

The method for implementing the network where coding parameters are discarded preferentially in order from the LSB side is by no means limited. For example, it is possible to use a packet network where priority control is carried out by assigning priority orders to coding parameters sectioned in FIG. 25 and transmitting the parameters using different packets.

In this embodiment, in FIG. 19, a configuration is shown provided with residual spectrum shape codebook 1905, residual spectrum gain codebook 1906 and multiplier 1907, but a configuration where these are not adopted is also possible. In this case, the encoder side is capable of carrying out communication at a low bit rate without transmitting the coded residual shape vector parameter and the coded residual gain parameter. Further, the decoding processing procedure in this case differs from the description using FIG. 19 in that there is no decoding processing of the residual spectrum information (shape, gain). Namely, a processing procedure is described using FIG. 20, but the bitstream is such that the position of (1) in FIG. 25 is the LSB.

Embodiment 3

In this embodiment, another configuration is shown for extended band decoding section 1403 of second layer decoding section 103 shown in FIG. 14 in Embodiment 2. In this embodiment, a decoding parameter for the corresponding frame is decided using the decoding parameter decoded by the extended band coded parameters on both of the frame and the previous frame and data loss information for the received bitstream on the frame, and the second decoded spectrum is decoded.

Figure 26:
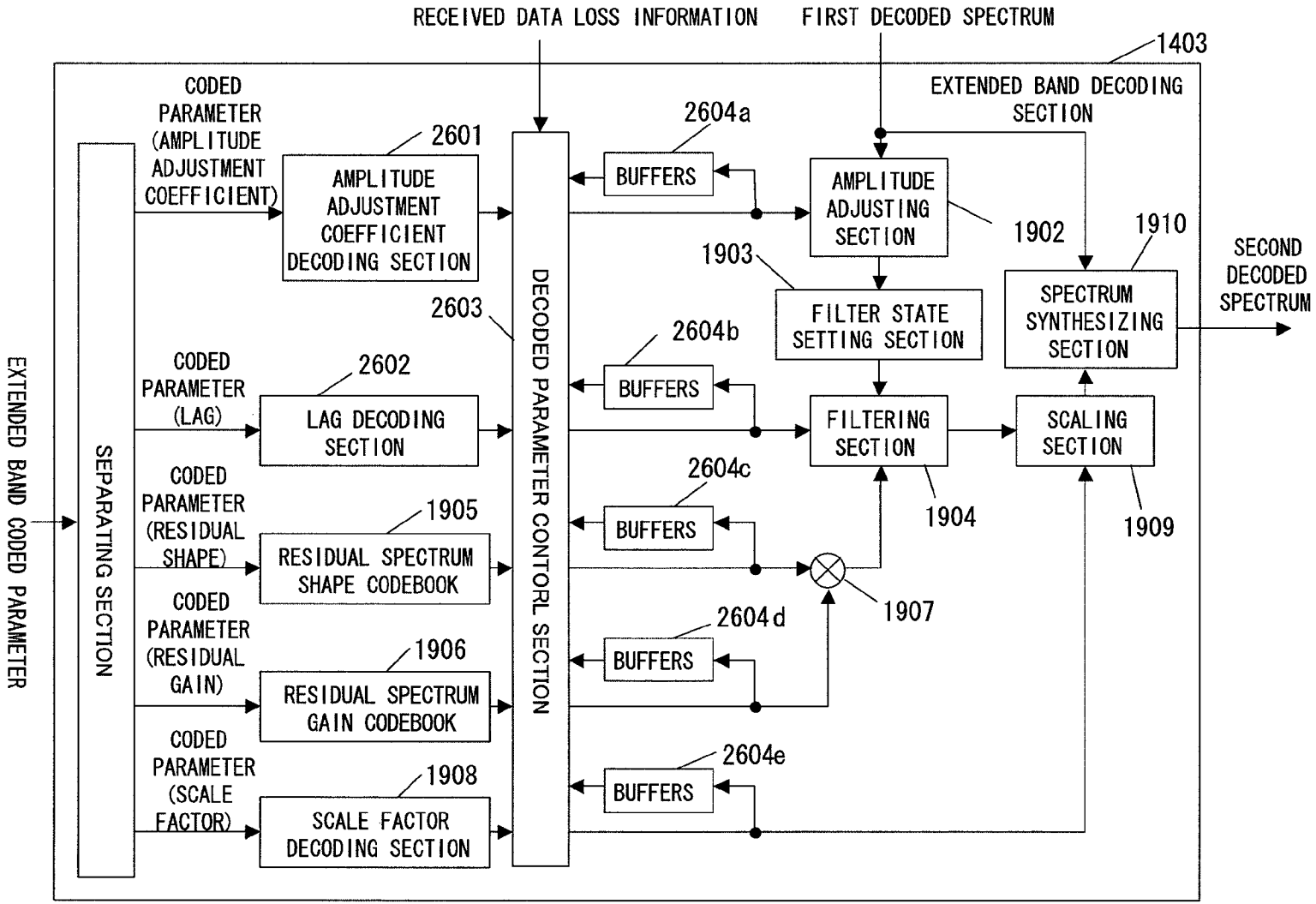
FIG. 26 is a block diagram showing a configuration of an extended band decoding section according to Embodiment 3 of the present invention.

FIG. 26 is a block diagram showing a configuration of extended band decoding section 1403 according to Embodiment 3 of the present invention. At extended band decoding section 1403 of FIG. 26, amplitude adjustment coefficient decoding section 2601 decodes an amplitude adjustment coefficient from the coded amplitude adjustment coefficient parameter. Lag decoding section 2602 decodes a lag from the coded lag parameter. Decoding parameter control section 2603 decides a decoded parameter used in decoding of the second decoded spectrum of the frame, using each decoded parameter decoded by the extended band coded parameter, received data loss information and each decoded parameter of the previous frame outputted from each buffer 2604*a* to 2604*e*. Buffers 2604*a* to 2604*e* are buffers for storing decoded parameters on the frame, those are amplitude adjustment coefficient(s), lag(s), residual shape vector(s), residual spectrum gain(s) and scale factor(s). Other aspects of the configuration in FIG. 26 are the same as the configuration of extended band decoding section 1403 of FIG. 19 and are therefore not described.

Next, the operation of extended band decoding section 1403 of the above configuration will be described.

First, the decoding parameters included in the extended band coded parameters that are part of the second layer coded data of the frame, that is, the coded parameters of the scale factor(s), lag(s), amplitude adjustment coefficient(s), residual shape vector(s) and residual spectrum gain(s) are decoded by decoding sections 1908, 2602, 2601, 1905 and 1906. Next, decoding parameter control section 2603 decides a decoding parameter used in decoding the second decoded spectrum of the frame, based on the received data loss information, using the decoded parameters and the parameter decoded on the previous frame.

Here, received data loss information is information indicating which portions of the extended band coded parameter cannot be used by extended band decoding section 1403 as a result of loss (including packet loss and the case where errors resulting from transmission errors are detected).

The second decoded spectrum is then decoded using the decoded parameters and first decoded spectrum obtained by decoding parameter control section 2603 and the first decoded spectrum. This specific operation is the same as for extended band decoding section 1403 of FIG. 19 in Embodiment 2, and is therefore not described.

Next, a first operating state of decoding parameter control section 2603 will be described below.

In the first operating state, decoding parameter control section 2603 substitutes a decoding parameter of the frequency band corresponding to the previous frame as the decoding parameter of the frequency band corresponding to a coding parameter that could not be obtained due to loss.

Specifically: when it is assumed that:

SF (n, m): scale factor for the mth frequency band of the nth frame

T(n, m): lag of the mth frequency band of the nth frame

γ(n, m): amplitude adjustment coefficient of the mth frequency band of the nth frame c (n, m): residual shape vector of the mth frequency band of the nth frame g (n, m): residual spectrum gain of the mth frequency band of the nth frame m=ML~MH ML: number of the lowest frequency band of the high band frequency band at the second layer MH: number of the highest frequency band of the high band frequency band at the second layer, if it is indicated in the received data loss information that it is not possible to receive some of the coding parameters of the mth band of the frame as a result of loss, a decoding parameter for the mth band of the previous frame is outputted as a decoding parameter corresponding to the lost coding parameter.

Namely, if the scale factor is lost;

$SF(n,m) \leftarrow SF(n-1,m)$ if the lag is lost;

$T(n,m) \leftarrow T(n-1,m)$ if the amplitude adjustment coefficient are lost;

$\gamma(n,m) \leftarrow \gamma(n-1,m)$ if the residual shape vector is lost;

$c(n,m) \leftarrow c(n-1,m)$ if the residual spectrum gain is lost;

$g(n,m) \leftarrow g(n-1,m)$

In place of the above, it is also possible to apply either (a) or (b) in the following.

(a) In a frequency band where any one of the five parameters is lost, the corresponding parameters of the previous frame are used as five parameters or a plurality of decoded parameters associated with an arbitrary combination.

(b) In a frequency band where any one of the five parameters is lost, a residual shape vector and (or) residual spectrum gain is set to be 0.

On the other hand, in a frequency band where loss does not occur, the parameter decoded using the coded parameter for the received frame is outputted as is.

Decoded parameters SF(n, m), T(n, M), γ(n, m), c(n, M), g(n, m):m=ML to MH for all bands of the high frequency of the frame are then outputted as decoded parameters of the frame.

When all coded second layer parameters are lost, in second layer frame concealment, the corresponding decoded parameter of the previous frame is used as an extended band decoded parameter for the entire band of the high frequency of the frame.

Further, in the above description, the situation has been described where decoding is always carried out using a decoding parameter of the previous frame at frames where loss has occurred, but another situation is also possible where decoding is carried out using the method described above only when correlation is higher than a threshold value based on correlation of a signal between the previous frame and the frame, and decoding is then carried out using a method closed within the frame in accordance with Embodiment 2 when correlation is lower than the threshold value. In this case, as an index indicating the correlation between the signal of the previous frame and the signal of the frame, there are correlation coefficients and spectrum distance between the previous frame and the frame, calculated using, for example, spectrum envelope information such as an LPC parameter obtained from the first layer coding parameter, information relating to voiced stationary of signals such as a pitch period and pitch gain parameter, first layer low band decoded signal, and the first layer low band decoded spectrum itself.

Next, a second operating state of decoding parameter control section 2603 will be described in the following.

In the second operating state, for the frequency band where data loss of the frame has occurred, decoding parameter control section 2603 obtains a decoded parameter for the frequency band using the decoded parameter for the frequency band of the previous frame and the decoded parameter for the frequency band neighboring the frequency band of the previous frame and the frame.

Specifically, when it is indicated in the received data loss information that a coded parameter for the mth band of the frame cannot be received due to loss, the decoded parameter is obtained in the following manner using the decoded parameter for the mth band of the previous frame ((n−1)th frame) as a decoded parameter corresponding to the lost coded parameter and the decoded parameter for the band (the same band as for the previous frame and the frame) neighboring the frequency band of the previous frame and the frame.

Namely, when the scale factor is lost;

$SF(n,m) \leftarrow SF(n-1,m)*SF(n,m-1)/SF(n-1,m-1)$ when the lag is lost;

$T(n,m) \leftarrow T(n-1,m)*T(n,m-1)/T(n-1,m-1)$ when the amplitude adjustment coefficient is lost;

$\gamma(n,m) \leftarrow \gamma(n-1,m)*\gamma(n,m-1)/\gamma(n-1,m-1)$ when the residual spectrum gain is lost;

$g(n,m) \leftarrow g(n-1,m)*g(n,m-1)/g(n-1,m-1)$ when the residual shape vector is lost;

$c(n,m) \leftarrow c(n-1,m)$ or 0

In place of the above, either (a) or (b) in the following may be appropriate.

(a) In a frequency band where any one of the above five parameters is lost, parameters obtained in accordance with that described above are used as five parameters or a plurality of decoded parameters associated with an arbitrary combination.

(b) In a frequency band where any one of the five parameters is lost, a residual shape vector and (or) residual spectrum gain is set to be 0.

On the other hand, at a frequency band where loss does not occur, parameters decoded using a coded parameter for the received frame are outputted as is.

Decoded parameters SF(n, m), T(n, m), γ(n, m), c(n, m), g(n, m):m=ML to MH for all bands of the high frequency of the frame are then outputted as decoded parameters for the frame.

In the above, a description is given taking the neighboring frequency band of frequency band m as m−1, but it is also possible to use a parameter of frequency band m+1. However, when the coding parameter is lost in the neighboring frequency band, it is possible to use the decoding parameter for another frequency band such as the closest frequency band where loss has not occurred.

Further, as with the first operating states described above, it is also possible to carry out decoding using the above-described method only for the case where correlation is higher than the threshold value based on correlation between the signal of the previous frame and the signal of the frame.

Moreover, it is also possible to decode only part of parameters (scale factor, or scale factor and amplitude adjustment coefficient) out of the above-described five decoded parameters using the decoded parameters calculated by the above-described processing, and decode the parameters other than these using the parameter for the frequency band of the previous frame, or carry out decoding using the method described in Embodiment 2.

Further, as another operating state, in a system where a plurality of coded frames are collectively multiplexed as a single packet and transmitted, there is a state where control is carried out so as to preferentially ensure (so as not to lose) the future coded parameters. In this situation, on the receiving side, when the received bitstream is decoded with a plurality of frames being collected together, the coding parameters for the lost frames can also be decoded in the same way as for the first operating state or for the second operating state using the coded parameters for frames before and after the frame. At this time, an interpolated value which is an intermediate value between the decoded parameter for the previous frame and the decoded parameter for the following frame is obtained and used as a decoded parameter.

Further, the following state is also possible.

(1) For the frequency band where loss occurs in an extended band coded parameter, the decoded spectrum in spectrum decoding section 1402B within second layer decoding section 103 shown in FIG. 14 is not added.

(2) At extended band decoding section 1403, a configuration is also possible where the residual spectrum shape codebook, residual spectrum gain codebook, and multiplier are not provided.

Further, in the above Embodiments 1 to 3, in either of these embodiments, a two-layer configuration example is shown, but three layers or more is also possible.

The above is a description of embodiments of a scalable decoding apparatus and a scalable encoding apparatus of the present invention.

The scalable decoding apparatus and scalable encoding apparatus according to the present invention is by no means limited to the above Embodiments 1 to 3, and various modifications thereof are possible.

The scalable decoding apparatus and the scalable encoding apparatus according to the present invention can be provided to a communication terminal apparatus and a base station apparatus in a mobile communication system so as to make it possible to provide a communication terminal apparatus and a base station apparatus having the same operation results as described above.

Moreover, in the above embodiments, the case has been described as an example where the present invention is implemented with hardware, the present invention can be implemented with software.

Furthermore, each function block used to explain the above-described embodiments is typically implemented as an LSI constituted by an integrated circuit. These may be individual chips or may partially or totally contained on a single chip.

Here, each function block is described as an LSI, but this may also be referred to as "IC", "system LSI", "super LSI", "ultra LSI" depending on differing extents of integration.

Further, the method of circuit integration is not limited to LSI's, and implementation using dedicated circuitry or general purpose processors is also possible. After LSI manufacture, utilization of a programmable FPGA (Field Programmable Gate Array) or a reconfigurable processor in which connections and settings of circuit cells within an LSI can be reconfigured is also possible.

Further, if integrated circuit technology comes out to replace LSI's as a result of the development of semiconductor technology or a derivative other technology, it is naturally also possible to carry out function block integration using this technology. Application in biotechnology is also possible.

The main characteristics of the scalable decoding apparatus of the present invention will be described below.

Firstly, according to the present invention, upon generation of the high band using mirroring, mirroring is carried out after adjusting the range of variations of the original low band spectrum that is mirrored, so that it is not necessary to transmit information relating to adjustment of the range of variations. As a result, it is possible to approximate a harmonic structure that is more like actual high band spectrum, and avoid generation of an excessive harmonic structure.

Secondly, according to the present invention, when lag information is not received due to transmission path errors, upon decoding of the encoded high band component, mirroring is carried out using the procedure of the first characteristic, and decoding processing is carried out for the high band component, so that it is possible to generate a spectrum having a harmonic structure at a high band without using the lag information. Further, the intensity of the harmonic structure can also be adjusted to a valid level. It is also possible to generate a pseudo spectrum using another technique in place of the mirroring.

Thirdly, according to the present invention, a bitstream is used in the order of scale factor, amplitude adjustment coefficient, lag and residual spectrum. When residual spectrum information is not received, a decoded signal is generated using only scale factor, amplitude adjustment coefficient and lag information. When lag information and residual spectrum information are not received, decoding processing is then carried out using the decoding procedure of the second characteristic.

Therefore, when the present invention is applied to a system designed so that the rate of occurrence of transmission errors and loss/discarding of coded information increases in order of scale factor, amplitude adjustment coefficient, lag and residual spectrum (that is, the scale factor is protected from errors with the highest priority, and preferentially transmitted on the transmission path), it is possible to minimize quality degradation of decoded speech due to transmission path errors. Further, the decoding speech quality gradually changes with decoding each parameter, so that it is possible to implement more fine grained scalability than in the related art.

Fourthly, according to the present invention, the extended band decoding section is provided with: a buffer for storing decoding parameters decoded from extended band coded parameters used for decoding of the previous frame; and a decoding parameter control section that decides a decoded parameter for the frame using the decoded parameters of the frame and the previous frame and using data loss information for the received bitstream for the frame, and generates a second decoded spectrum using the first decoded spectrum for the frame and the decoded parameter outputted from the decoding parameter control section. Therefore, when part or all of extended band coded data obtained by encoding the high band utilizing a filter having the low band spectrum as an internal state is lost and therefore cannot be used in decoding, it is possible to perform loss concealment using decoding parameters for the previous frame where the degree of similarity is high as a replacement, and decode a signal at high quality even when data loss occurs.

With the fourth characteristic, for the frequency band where data loss of the frame has occurred, the decoding parameter control section may obtain the decoding parameter for the frequency band using decoding parameters for the frequency band of the previous frame and decoding parameters for the frequency band neighboring the frequency band of the previous frame and the frame. As a result, when the coding parameter of the previous frame whose degree of similarity is high is used, it is possible to utilize the relationship of changes in time of frequency bands neighboring the frequency band of the target of the concealment and carry out precise concealment.

The present application is based on Japanese Patent Application No. 2004-322954, filed on Nov. 5, 2004, entire content of which is expressly incorporated by reference herein.

INDUSTRIAL APPLICABILITY

The scalable decoding apparatus and scalable encoding apparatus of the present invention can be applied to a mobile communication system and a packet communication system using Internet protocol.

The invention claimed is:

1. A scalable decoding apparatus comprising:

a first decoder that decodes low frequency band coded information and obtains a low frequency band decoded signal; and a second decoder that obtains a high frequency band decoded signal from the low frequency band decoded signal and high frequency band coded information, wherein the second decoder comprises:

a transformer that transforms the low frequency band decoded signal and obtains a low frequency band spectrum;

an adjuster that carries out amplitude adjustment on the low frequency band spectrum using an adjustment coefficient, selected from a plurality of prepared coefficients according to an index indicating a depth of valleys of spectrum harmonics of the low band decoded signal; and a generator that generates a high frequency band spectrum using the amplitude-adjusted low frequency band spectrum and the high frequency band coded information.

2. The scalable decoding apparatus according to claim 1, wherein the generator carries out mirroring on the amplitude-adjusted low frequency band spectrum and generates the high frequency band spectrum.

3. The scalable decoding apparatus according to claim 1, wherein the generator generates the high frequency band spectrum when at least part of the high frequency band coded information cannot be decoded.

4. The scalable decoding apparatus according to claim 1, wherein the generator carries out pitch filtering processing on the amplitude-adjusted low frequency band spectrum and generates the high frequency band spectrum.

5. The scalable decoding apparatus according to claim 1, wherein the high frequency band coded information is configured in a priority of scale factor, amplitude adjustment coefficient, lag and residual spectrum, and the generator generates the high frequency band spectrum using the scale factor, the amplitude adjustment coefficient and the lag when the residual spectrum is lost at the high frequency band coding information.

6. The scalable decoding apparatus according to claim 1, wherein the high frequency band coded information is configured in a priority of scale factor, amplitude adjustment coefficient, lag and residual spectrum, and the generator carries out mirroring on the amplitude-adjusted low frequency band spectrum and generates the high frequency band spectrum when the lag and the residual spectrum are lost at the high frequency coding information.

7. The scalable decoding apparatus according to claim 1, wherein the high frequency band coded information is configured in a priority of scale factor, amplitude adjustment coefficient, lag and residual spectrum, and the generator generates the high frequency band spectrum using past information corresponding to lost information when at least one of the scale factor, the amplitude adjustment coefficient, the lag and the residual spectrum is lost.

* * * * *